US011554059B2

(12) United States Patent
Cohen Gazit et al.

(10) Patent No.: US 11,554,059 B2
(45) Date of Patent: Jan. 17, 2023

(54) HEAD SUPPORT ASSEMBLY AND SUPPORT UNIT

(71) Applicant: Headovations Ltd., Tel Aviv (IL)

(72) Inventors: Ben Cohen Gazit, Tel Aviv (IL); Kalman Shaham, Tel Aviv (IL); Michael Librus, Netanya (IL)

(73) Assignee: Headovations Ltd., Tel Aviv (IL)

( * ) Notice: Subject to any disclaimer, the term of this patent is extended or adjusted under 35 U.S.C. 154(b) by 68 days.

(21) Appl. No.: 17/049,146

(22) PCT Filed: Apr. 21, 2019

(86) PCT No.: PCT/IL2019/050456

§ 371 (c)(1),
(2) Date: Oct. 20, 2020

(87) PCT Pub. No.: WO2019/207580

PCT Pub. Date: Oct. 31, 2019

(65) Prior Publication Data

US 2021/0236356 A1 Aug. 5, 2021

(30) Foreign Application Priority Data

Apr. 22, 2018 (IL) ..... 258832

(51) Int. Cl.
*A47C 7/38* (2006.01)
*A61G 5/12* (2006.01)
(Continued)

(52) U.S. Cl.
CPC ..... *A61G 5/0825* (2016.11); *A61G 5/1054* (2016.11); *A47C 7/383* (2013.01); *A61G 5/12* (2013.01)

(58) Field of Classification Search
CPC .... A47C 7/383; A61G 5/0816; A61G 5/0825; A61G 5/121
(Continued)

(56) References Cited

U.S. PATENT DOCUMENTS 3,142,351 A 7/1964 Green
3,429,615 A * 2/1969 Belk ..... B60N 2/812 297/397 X
(Continued)

FOREIGN PATENT DOCUMENTS

CN 1468751 A 1/2004
CN 201143048 Y 11/2008
(Continued)

OTHER PUBLICATIONS

"Zippie Iris Tilt in Space Wheelchair", https://www.sunrisemedical.com/manual-wheelchairs/zippie/tilt-in-space-wheelchairs/iris?lang=en-CA#prettyPhoto, 2022, 9 pages.

*Primary Examiner* — Rodney B White
(74) *Attorney, Agent, or Firm* — Dorsey & Whitney LLP

(57) ABSTRACT

A support unit for a modular head support assembly having a right support post and a left support post, said support unit comprising: a support body; a right attachment element and a left attachment element configured for articulation with said right support post and said left support post, respectively, said right attachment element and said left attachment element being disposed at opposite sides of the support body; and an adjustment mechanism configured for selectively adjusting the position of the right attachment element and the left attachment element with respect to each other, at least from an extended position towards a retracted position.

22 Claims, 30 Drawing Sheets

(51) Int. Cl.
*A61G 5/08* (2006.01)
*A61G 5/10* (2006.01)

(58) Field of Classification Search
USPC ..... 297/393, 397, 487
See application file for complete search history.

(56) References Cited

U.S. PATENT DOCUMENTS 3,476,404 A 11/1969 Rachman
3,497,259 A * 2/1970 Sherfey ..... A61G 5/1054 297/391
3,643,996 A * 2/1972 Carnahan ..... A61G 5/121 297/392 X
3,730,589 A * 5/1973 Lane ..... A61G 5/121 297/391
3,891,268 A 6/1975 Taylor
3,901,337 A * 8/1975 Cragg ..... C04B 2/10 180/65.6
4,227,740 A * 10/1980 East ..... A61G 5/1089 297/397 X
4,415,177 A * 11/1983 Hale ..... A61G 5/121 280/650 X
4,565,385 A * 1/1986 Morford ..... A61G 5/125 280/250.1 X
4,592,570 A * 6/1986 Nassiri ..... A61G 5/1097 280/250.1 X
4,617,919 A * 10/1986 Suhre ..... A61G 5/128 280/250.1 X
4,989,836 A * 2/1991 Hudson, III ..... A47C 7/383 297/391
5,074,574 A * 12/1991 Carwin ..... A61G 5/121 297/397
5,168,889 A 12/1992 Diestel
5,188,383 A * 2/1993 Thompson ..... A61G 5/128 280/42
5,306,232 A * 4/1994 Whitmyer ..... A61G 5/121 602/17
5,338,048 A * 8/1994 Medina ..... A61G 5/121 280/5.22
5,395,158 A * 3/1995 Cordia ..... A61G 5/121 297/393 X
5,395,195 A 3/1995 Fulmer
5,511,854 A * 4/1996 Cordia ..... A61G 5/12 297/393 X
5,586,810 A * 12/1996 Liu ..... B60N 2/885 297/406 X
5,967,613 A * 10/1999 McKeever ..... A61G 5/12 297/397 X
6,095,611 A * 8/2000 Bar ..... A61G 5/1067 297/397 X
6,105,997 A 8/2000 Watkins
6,135,475 A 10/2000 Brown et al.
6,460,927 B1 * 10/2002 Groth ..... A61G 5/12 297/410
7,032,974 B1 4/2006 Berger
7,140,678 B1 11/2006 Grant
7,207,630 B1 * 4/2007 Reynolds ..... A61G 5/1054 297/397 X
8,448,728 B2 5/2013 Schneider
9,084,710 B2 7/2015 Paul et al.
9,566,885 B2 2/2017 Gazit
2003/0006578 A1 1/2003 Melgarejo et al.
2004/0051279 A1 3/2004 Grant et al.
2007/0108827 A1 5/2007 Clough
2010/0078053 A1 4/2010 Hughes
2011/0260519 A1 * 10/2011 Carrigan, Sr. ..... B60N 2/882 297/397
2016/0068086 A1 3/2016 Gazit
2017/0190349 A1 7/2017 Tan
2021/0100702 A1 * 4/2021 Su ..... A61G 5/1091

FOREIGN PATENT DOCUMENTS

CN 202263113 U 6/2012
CN 203029506 U 7/2013
CN 103791021 A 5/2014
CN 203935342 U 11/2014
CN 203953991 U 11/2014
CN 205007152 U 2/2016
CN 205814038 U 12/2016
CN 107049623 A 8/2017
DE 202005019582 U1 3/2006
FR 3022127 B3 7/2016
GB 2213437 A * 8/1989 ..... A61G 5/08
GB 2258639 A 2/1993
JP 2004113722 A 4/2004
JP 2005028095 A 2/2005
JP 2007167320 A 7/2007
JP 2010268868 A 12/2010
JP 3174020 U 2/2012
JP 5858545 B2 12/2015
JP 3212917 U 9/2017
KR 20120134256 A 12/2012
KR 20140116635 A 10/2014
KR 101487376 B1 1/2015
RU 174902 U1 11/2017
WO 2007018926 A2 2/2007

* cited by examiner

HEAD SUPPORT ASSEMBLY AND SUPPORT UNIT

TECHNOLOGICAL FIELD

The present disclosure is directed to a head support assembly for a seat, and a support unit for use with a head support assembly.

BACKGROUND

JP5858545 discloses a headrest fixed to a support member for supporting a backrest of a wheelchair, comprising: a pair of fixing portions fixed to the support member and extending upward from below to form a tubular body; a pair of shaft portions respectively inserted from the lower end side into the inside of the wheelchair, a pair of shaft portions fixed to the upper end sides of the pair of shaft portions on the left and right side edges, formed in a fabric material of a flexible material, a main body that supports a head of a user sitting on a side of the main body, wherein the main body includes: a tubular shaft portion insertion portion into which the shaft portion is inserted at one side edge; a first surface joining portion formed in a range from one end portion to a center portion and a second surface joining portion formed in a range from the center to the other end portion and detachably joined to the first surface joining portion, wherein the main body has one shaft portion inserted into the shaft portion insertion portion folding the other of the shaft portion as a fulcrum, wherein the first interview engaging portion by the second interview engaging portion are joined, a headrest which is fixed to the pair of the shaft portion.

JP3174020 discloses a hooded wheelchair comprising: a wheelchair including a seat portion and a backrest portion; and a hood mechanism for covering a user seated on the wheelchair, wherein the hood mechanism comprises a hood having a hooked portion, a support frame extending in the longitudinal direction of the support frame, an accommodation frame elongated in the vertical direction provided at the inner end of the support frame, a telescopic rod accommodated in the accommodation frame so as to be vertically expandable and retractable, and a foldable hood which moves upward by stretching the rod.

U.S. Pat. No. 9,566,885 discloses a head restraint, comprising: a headrest member configured with a back portion and two side portions extending therefrom, the side portions are foldable with respect to the back portion so as to allow the headrest member to assume a first state in which the side portions are spaced from each other at a first extent and a second state in which the side portions are spaced from each other to a second extent which is smaller than said first extent; a mounting arrangement articulated to the headrest member for mounting the head restraint to a seat; and a restraining member pivotally articulated to said side portions and configured for rotation at least between an upward position and a downward position, wherein displacement of the restraining member between its upward position and its downward position is configured to cause the headrest member to assume its first and second states, respectively.

GENERAL DESCRIPTION

According to a first aspect of the presently disclosed subject matter, there is provided a support unit for a modular head support assembly having a right support post and a left support post, said support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting the position of the right attachment element and the left attachment element with respect to each other, at least from an extended position towards a retracted position.

According to a second aspect of the presently disclosed subject matter, there is provided a modular head support assembly configured to be attached to a seat, the head support assembly comprising:

a right support post and a left support post, configured to be attached to a right side frame member and a left side frame member of the seat, respectively, by at least one coupler unit; and a support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting the position of the right attachment element and the left attachment element with respect to each other, at least from an extended position towards a retracted position.

According to a third aspect of the presently disclosed subject matter, there is provided a wheelchair comprising:

a right side frame member and a left side frame member;

a modular head support assembly configured to be attached to the wheelchair, the head support assembly comprising: a right support post and a left support post, configured to be attached to the right side frame member and the left side frame member, respectively, by at least one coupler unit; and a support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting the position of the right attachment element and the left attachment element with respect to each other, at least from an extended position towards a retracted position.

The wheelchair can be a collapsible wheelchair configurable between a collapsed position and a deployed position.

The term 'seat' as used herein denotes any device having a seat portion and a back portion configured for supporting a sitting user, and can be any one of the following: a wheelchair, a booster seat, a safety seat, a stroller, a vehicle seat, a chair, a bench, etc.

The adjustment mechanism can be configured for adjusting the position of the right attachment element and the left attachment element with respect to each other between the extended position and the retracted position. In other words, the adjustment mechanism can be also configured to adjust the position of the right attachment element and the left attachment element from the retracted position to the extended position.

The adjustment of the position of the right attachment element and the left attachment element with respect to each other can be provided in different ways. For example, the adjustment can be performed by changing the structure and/or the position (either angular or linear displacement) and/or the dimensions of any one of the right attachment element and the left attachment element, or both of them.

The modular head support assembly is configured to be attached to any seat having right and left side frames. The modular head support assembly can comprise the at least one coupler unit which can comprise a right coupler unit and a left coupler unit. The right support post can be attached to the right side frame member of the seat by a right coupler unit of the at least one coupler unit and the left support post can be attached to the left side frame member of the seat by a left coupler unit of the at least one coupler unit.

The right support post and the left support post typically extend vertically upwards in parallel to each other, defining a certain distance therebetween. When the right support post and the left support post are attached to the right and left side frame members, the distance therebetween is dictated by the width of the seat, and in particular, by the structure and the distance between the right and left side frame members of the seat. This distance can change from one seat to another, or be dependent on the locations at which the right and left posts are articulated to the side frame of a particular seat. Thus, the right attachment element and the left attachment element are adjustable with respect to each other in order to detachably attach the support unit to the right and left support posts. Also, the right attachment element and the left attachment element are adjustable to fit the distance therebetween to the distance between the right support post and the left support post being attached the right and left side frame members. The adjustment can enable the right attachment element and said left attachment to assume any one intermediate position from a plurality of intermediate positions, or any one discrete predetermined position from a plurality of discrete predetermined positions between the extended position and the retracted position.

The support unit can be articulated to either one of a top end portion or a bottom end portion of the right and left support posts. In some cases, when articulated to the top end portion of the support posts, the support unit can be configured for providing support for a head of a user seated on the seat. In some cases, the support body is configured with a front portion to which a head restraint is attachable. in such cases, the head restraint is configured for providing improved head and neck support to a user while seated in the seat, e.g., in case the user falls asleep or in case of an individual with physical disorders. More particularly, the head restraint is configured for preventing the user's head from falling forward, and furthermore, for preventing the user's head from tilting to the left or the right side. This provides comfortable and stable support of the user's head while sitting on the seat.

According to a particular example, the head restraint can be the one disclosed in U.S. Pat. No. 9,566,885, the content of which is incorporated herein by reference. The head restraint can comprise: a headrest member configured with a back portion and two side portions extending therefrom, the side portions are foldable with respect to the back portion so as to allow the headrest member to assume a first state in which the side portions are spaced from each other at a first extent and a second state in which the side portions are spaced from each other to a second extent which is smaller than said first extent; a mounting arrangement articulated to the headrest member for mounting the head restraint to a seat; and a restraining member pivotally articulated to said side portions and configured for rotation at least between an upward position and a downward position, wherein displacement of the restraining member between its upward position and its downward position is configured to cause the headrest member to assume its first and second states, respectively. In use, when the user's head is positioned at the head restraint, the restraining member of the in its upward position can be located substantially above the use's head, and in its downward position, the restraining member can be located substantially in front of the user's forehead.

Any one or more of the following features, designs and configurations can be incorporated in the support unit and the head support assembly of the first, second and third aspect of the presently disclosed subject matter, independently or in combination thereof:

The support unit can be fully rigid.

The right attachment element and the left attachment element can be rigid.

The support unit can be at least partially flexible.

The right attachment element and the left attachment element can be flexible.

The adjustment mechanism can further comprise a fixing mechanism configured to prevent said right attachment element and said left attachment element from being adjusted at least from any one intermediate position from a plurality of intermediate positions towards the extended position.

The fixing mechanism can be configured to fix said right attachment element and said left attachment element at any one intermediate position from a plurality of intermediate positions between the extended position and the retracted position.

The fixing mechanism can comprise a locked state at which the right attachment element and said left attachment element are restricted from adjustment with respect to each other at least towards the extended position, and an unlocked state, at which the right attachment element and said left attachment element are adjustable with respect to each other. The support unit can be further configured for adjusting the position of the right attachment element and the left attachment element with respect to each other between the extended position and the retracted position. According to a particular example, the fixing mechanism at the locked state thereof is configured to restrict the adjustment of the right attachment element and the left attachment element with respect to each other towards both the extended position and the retracted position.

The right attachment element and the left attachment element can be adjustable at least from the extended position towards the retracted position and/or from the retracted position towards the extended position by being adjusted so that the distance between the right attachment element and the left attachment element is a first distance, and at the extended position, the distance between the right attachment element and the left attachment element is a second distance which is greater than the first distance. In a particular example of the subject matter, at the retracted position, the right attachment element and the left attachment element can be adjacently positioned to the opposite lateral sides of the support body and/or to each other. At the extended position, the right attachment element and the left attachment element can be each maximally spaced apart from the support body and/or from each other.

The support body has a longitudinal axis, and the position of the right attachment element and the left attachment element with respect to each other is linearly adjustable along said longitudinal axis. The adjustment of the right attachment element and the left attachment element with respect to each other can be performed by displacing them towards and/or from each other along said longitudinal axis. In some cases, the adjustment mechanism can extend at least partially along said longitudinal axis. In such cases, movement of the adjustment mechanism along the longitudinal axis can displace the right attachment element and the left attachment element between the extended position and the retracted position. The adjustment mechanism can extend at least partially within said support body.

The adjustment mechanism can be configured to simultaneously adjust the position of both the right attachment element and the left attachment element. According to a particular example, adjusting one of the right attachment element and the left attachment element can entail adjustment of the other one of the right attachment element and the left attachment element. The simultaneous adjustment of the position of the right attachment element and the left attachment element can be such that the right attachment element and the left attachment element are displaced at the same distance. In such example, the distance between the right attachment element to the support body and the left attachment element to the support body is constantly substantially same. According to another particular example of the presently disclosed subject matter, the support body can be substantially symmetrical having the right attachment element and the left attachment element at substantially equal distances from the center thereof. In such example, the support body is maintained at a central position between the right attachment element and the left attachment element.

The adjustment mechanism can be operated by a user to increase or decrease the distance between the right attachment element to the left attachment element. In a particular example of the disclosed subject matter, a single operation of the user adjusts both of the right attachment element and the left attachment element, either towards the extended position and/or towards the retracted position.

The right attachment element and the left attachment element can be connected at opposite sides of the support body via a right extending element and a left extending element, respectively.

The adjustment mechanism can be configured to adjust and fix said right attachment element and said left attachment element by adjusting and fixing the right extending element and said left extending element with respect to the support body.

The adjustment mechanism can be configured to adjust and fix said right attachment element and said left attachment element with respect to each other at any one intermediate position from a plurality of intermediate positions between the extended position and the retracted position. The adjustment of the right attachment element and the left attachment element to any intermediate position between the extended position and the retracted position enables a user to adjust the support unit to a plurality of seats having different widths.

In a particular example of the disclosed subject matter, the adjustment mechanism can comprise a right and left drive elements, oppositely disposed to one another along the length of the right extending element and the left side extending element, respectively; and a driving gear comprising a driving portion engaged with both of the right and left drive elements.

The right extending element can comprise a right elongate opening formed therein. The right elongate opening can comprise a right upper rim and a right lower rim, and the right drive element can extend on one of the right upper and lower rim. The left extending element can comprise a left elongate opening formed therein. The left elongate opening can comprise a left upper rim and a left lower rim, and the left drive element can extend along the opposite rim to the rim on which the right drive element extends along. The driving portion can extend through both the right elongate opening and the left elongate opening. The right elongate opening and the left elongate opening can be configured to at least partly overlap for enabling the driving portion to extend therethrough. The right elongate opening and the left elongate opening can further comprise right and left distal rims and right and left proximal rims. In such example, the right and left drive elements extend between the right and left distal rims and the right and left proximal rims.

The right and left distal rims can be situated closest to the attachment element of each of the right extending element and the left extending element, respectively, and can be configured to determine the retracted position and the extended position of the right extending element and the left extending element. Thus, at the retracted position, the driving gear may engage the distal rims of both of the right extending element and the left extending element. Also, at the extended position, the driving gear may engage the proximal rims of both of the right extending element and the left extending element.

In a particular example of the disclosed subject matter, movement of the driving gear towards a first direction entails respective adjustment of said right and left attachment elements towards the extended position, and movement towards a second opposite direction, entails respective adjustment of said right and left attachment elements towards the retracted position.

The driving gear can further comprise a latch portion selectively engageable with a locking portion of the support body. The latch portion and the locking portion can constitute at least a part of the fixing mechanism of the adjustment mechanism for fixing the position of the right attachment element and the left attachment element with respect to each other. In a particular example, the locking portion is designed in a complementary manner to the latch portion, such that when the latch portion is moved into engagement with the locking portion, the latch portion is flush with the locking portion and is prevented from movement.

Thus, the driving gear is configurable between:

a locked state, at which the latch portion is engage with the locking portion, so as to prevent the driving gear from movement; and an unlocked state, at which the latch portion is disengaged from the locking portion, so as to enable movement of the driving gear.

The driving gear can configurable between the locked state and the unlocked state by being slidably displaceable towards and away with respect to the support body and perpendicularly to the longitudinal axis of the support body. In a particular example, the driving gear can be disposed at the center of the support body, and can change the state thereof by being pulled and pushed by the user, towards and from the support body, respectively.

The latch portion can comprise one or more teeth configured to be received at one or more depressions of the locking portion. In some cases, the latch portion can be formed in a polygonal shape other than circle. The number of positions and the distance between the positions in cases of discrete intermediate positions, can be determined by the number of teeth of the latch portion and the distance/angle between the teeth.

In a particular example of the presently disclosed subject matter, the driving portion can be a pinion and each one of said right and left drive elements can be a rack. The driving gear can extend from driving portion positioned within the support body through and outwards from the rear portion of the support body, perpendicularly to the longitudinal axis. The latch portion of the driving gear can be at least partly positioned on the external part of the driving gear. The latch portion can be formed as an actuating knob, enabling a user to conveniently push the driving gear to change the state thereof to a locked state, pull the driving gear to change the state thereof to an unlocked state, and while in unlocked state to rotate the driving gear clockwise or counterclockwise.

The support body can comprise a tunnel extending between the opposite sides of the support body along the longitudinal axis and is configured to accommodate at least a section of the right extending element and the left extending element.

The right extending element can comprise at least one right slide member and the left extending element can comprise at least one second slide member slidably secured to the at least one first slide member. The tunnel can be configured to have a complementary shape to the shape of the right extending element and the left extending element being slidably secured together.

The tunnel can further comprise a right side protrusion protruding into the tunnel and configured to engage at least a section of the right extending element; and a left side protrusion protruding into the tunnel and configured to engage at least a section of the left extending element. The right side protrusion and the left side protrusion can be situated at opposite ends of the tunnel, and in some cases from opposite surfaces of the tunnel. In such example, the right side protrusion is configured to prevent the right extending element from extending from a left side of the tunnel and the left side protrusion is configured to prevent the right extending element from extending from a left side of the tunnel and the left extending element from extending from a right side of the tunnel.

In a particular example of the presently disclosed subject matter, each one of the right and left attachment elements comprises a mounting bore configured for receiving therein a section of the respective support post.

Each of the mounting bores can comprise a bore opening formed at a bottom surface of each respective attachment element and configured for receiving therethrough a top or bottom section of the respective support post. In other examples, the bore can be disposed on the lateral surface of each respective attachment element and configured for receiving a middle section of the respective support post.

Each one of the right and left attachment elements can comprise a securing element disposed at its respective mounting bore for securing the respective support post inside said respective mounting bore. The securing element can be configured to detachably secure the support unit to the respective support post for securing the connection from one end, and to enable convenient detachment of the support unit from the respective support pole.

The securing element disposed at the respective mounting bore of the right and left attachment elements is a magnet disposed at an internal end of the mounting bore. In such cases, the respective support post can comprise a material configured to be magnetically attached to the magnet. In other cases, the respective support post can comprise the magnet and the securing element can be formed from the material configured to be magnetically attached to the magnet.

Each one of the right and left attachment elements can further comprise a pivotal member including the mounting bore and pivotally rotatable within an interior of the respective attachment element.

The support body can comprise a handle, extending upwards and spaced from a top portion of the support body, forming a gap therebetween. The gap is designed such that at least one upper strap of the head restraint can extend through the gap for securing the head restraint to the support body.

The support body can comprise a lower section having at least one aperture disposed thereon. The lower section can comprise front apertures designed such that at least one lower strap of the head restraint can extend through the front apertures for securing the head restraint to the support body. the lower section can comprise lateral apertures, to which a plurality of convenient devices are attachable. Such convenient devices can comprise articulating arms for supporting beverages and the like.

According to another particular example of the presently disclosed subject matter, the head restraint can be integral with the front portion of the support unit.

The adjustment mechanism can be configured for selectively adjusting the position of the right attachment element and the left attachment element by displacing or facilitating displacement thereof.

In some examples, the support body can comprise a right body member connected to the right attachment element at a right end thereof, and a left body member connected to the left attachment element at a left end thereof, said right body member and said left body member are pivotally articulated to one another by the adjustment mechanism; and wherein pivotal displacement of the right body member with respect to the left body member can be configured for selectively adjusting the position of the right attachment element and the left attachment element with respect to each other, between the extended position and the retracted position.

In such example, the support unit can further comprise a second adjustment mechanism, which can comprise: a right extending member, connecting the right attachment element to the right body member and a left extending member connecting the left attachment element to the left body member, said right extending member and said left extending member are configurable between an extended position and a retracted position.

Furthermore, at the extended position, the right extending member and said left extending member maximally extend out from the right body member and the left body member, respectively, and at the retracted position, the right extending member and said left extending member are maximally disposed within the right body member and the left body member, respectively. The at least one coupler unit can comprise a right coupler unit and a left coupler unit. The right support post can be attached to the right side frame member of the seat by the right coupler unit of said at least one coupler unit and the left support post can be attached to the left side frame member of the seat by the left coupler unit.

Each one of the right and left coupler units can comprise a support post receiving member for receiving a support post therethrough, a mounting mechanism attachable to the respective side frame member, and an height fixing mechanism configured for selectively arresting the respective support post with respect to the support post receiving member. The receiving member can be formed by a vertically positioned pipe. The height fixing mechanism can be situated along the receiving member or adjacent to either one of the ends thereof. In some examples, the mounting mechanism extends sideways from the top section of the post receiving member. In such examples, the mounting mechanism can extend from the external side of the post receiving member, so as to prevent increase in the width of the seat. In a specific example, the respective side frame member to which the mounting mechanism is attachable is a handle extending arcing from the back section of the frame rearwards.

The support posts can be height adjustable, so as to adjust the height at which the support unit extends with respect to the backrest of the wheelchair.

The support posts can be height adjustable by a telescopic arrangement comprising two or more support posts axially displaceable and arrested by a height fixating mechanism.

The mounting mechanism can comprise a first frame engaging section and a complementary second frame engaging section configured for tightly receiving therebetween the respective side frame member. The first frame engaging and the second frame engaging section can be tightly attached to each other by at least one attaching element. The at least one attaching element can comprise screws and nuts.

Each one of the first frame engaging section and the second frame engaging section can comprise a depression formed at a frame engaging side thereof, and a first and second elastomer unit extending through the length of the depression, said elastomers are configured to enable the mounting mechanism for receiving diversely formed side frame members therebetween. In an example of the presently disclosed subject matter, the mounting mechanism can be configured to be attached to an arced handle section of the seat. In such cases, the frame engaging side of the first frame engaging section can be convexly formed, and the frame engaging side of the second frame engaging section can be concavely formed corresponding to the frame engaging side of the first frame engaging section. The elastomers can be configured to mediate different designs of the side frame members, such that the first frame engaging section and the second frame engaging section would be able to tightly receive the side frame members therebetween regardless of the design differences.

Both of the right and left support posts can comprise a shock absorber formed at a top section thereof. The shock absorber can be configured as section of the right and left support posts at which the support unit is attachable. The shock absorber can be used to mitigate damages to the support unit attached thereon in cases the support posts fall down fastly. Additionally, the shock absorber can be used to substantially level the top section of the support post with the respective coupler unit.

Each one of the right shock absorber and left shock absorber is configured to be magnetically attachable to the right attachment element and the left attachment element, respectively. The right shock absorber and left shock absorber can be magnetically attachable by comprising a magnet or a magnetically attracted material configured to be attracted to a magnet disposed inside the right and left attachment portions of the support unit.

Each one of the right and left shock absorbers can be configured to be secured inside the respective mounting bore by a securing element disposed therein.

The securing element disposed at the respective mounting bore can be configured to magnetically interact with the respective shock absorber received therein.

Each one of the right and left shock absorbers can comprise a spring mounting member disposed within the top section, an external stopper wider than the support post and displaceable towards and from the spring mounting member along a stopper track disposed vertically below the spring mounting member, and a spring interconnecting the spring mounting member and the stopper. The spring mounting members can be situated at the upper end of the right and left shock absorbers. The external stopper can also be wider than the width of the support post receiving section of the coupler unit. For example, insertion of a respective support post into the support post receiving section arrest the support post upon engagement of the external stopper with support post receiving section.

The spring can be configured for normally biasing the stopper away from the spring mounting member along the stopper track. Thus, the stopper can be positioned by default at the bottom of the stopper track. For example, when the stopper is being pushed upwards along the stopper track, the spring applies compression forces on the stopper entailing the stopper back to the bottom of the stopper track.

The stopper track can be disposed below the spring mounting member and extends to a distance corresponding to the length of a respective mounting bore disposed in each respective attachment element, which is configured for receiving therein the respective shock absorber of the respective support post. Thus, when the support post is fully inserted to the coupler unit, the support unit may be attached on the top section of the support post, which extends above the coupler unit. In some cases, this attachment positions the support unit at an ideal position with respect to a person seated on the seat.

According to a fourth aspect of the presently disclosed subject matter, there is provided:

a wheelchair modular head support assembly comprising:

a right support post and a left support post, each configured for attaching to a respective side frame member of a wheelchair;

at least one of a top bar extending between top end portions of the support posts, and a bottom bar extending between bottom end portions of the support posts, respectively; the bottom bar and the top bar each being configured with a right bar member and a left bar member, extending from a portion of the right support post and a portion of the left support post, respectively, wherein the left bar member and right bar member are pivotally articulated to one another; and the head support assembly being configured to be folded and unfolded such that during the course of folding and unfolding, at least the portions of the support posts, from which the right and left bar members extend, are configured to rotate about longitudinal axis of the respective support post, thereby causing the left bar member and the right bar member to pivot about a pivot axis extending substantially parallel to the support posts;

wherein a head support unit is attachable over top portions of the support posts.

The head support unit can be flexible.

The head support assembly can be configured for use with a foldable wheelchair, wherein the bottom bar and the top bar extend at a right angle with respect to the support posts At a fully collapsed position, the left bar member and the right bar member can extend substantially parallel to one another and at a fully expanded position, the left bar member and the right bar member coextend.

The right bar member and the left bar member can be integral with the respective right support post and left support post.

According to yet a specific embodiment, the top bar extends from the top portion of the support posts, said top portion being pivotally articulated to the support post, between a folded position at which the top portion is substantially parallel to the support post, and an extended position at which the top portion coextends with the support post.

The head support assembly can be configured for use with a foldable wheelchair of the type comprising two side frames articulated to one another by a collapsible cross-frame, and wherein the support posts are attachable to a left back post and right back post of the respective left side frame and right side frame.

At an operative state, at least a top portion of the support posts is configured for disposing at a height above a back rest of the wheelchair and supporting the head support unit at a height above the back rest.

According to a fifth aspect of the disclosure there is a foldable wheelchair configured with two side frames connected to one another by a collapsible cross frame, and a modular head support assembly comprising a right support post and a left support post, each configured for attaching to a rear bar of a respective side frame member of the wheelchair, at least one of a top bar extending between top end portions of the support posts, and a bottom bar extending between bottom end portions of the support posts, respectively; the bottom bar and the top bar each being configured with a right bar member and a left bar member, extending from a portion of the right support post and a portion of the left support post, respectively, wherein the left bar member and right bar member are pivotally articulated to one another; the head support assembly being configured to be folded and unfolded such that during the course of folding and unfolding, at least the portions of the support posts, from which the right and left bar members extend, are configured to rotate about longitudinal axis of the respective support post, thereby causing the left bar member and the right bar member to pivot about a pivot axis extending substantially parallel to the support posts; wherein a head support unit is attachable over top portions of the support posts.

The head support unit can be flexible.

The head support assembly can be configured to be folded along with the foldable wheelchair, wherein the bottom bar and the top bar extend at a right angle with respect to the support posts.

Any one or more of the following features, designs and configurations can be associated with the head support assembly and the wheelchair according to the fourth and fifth aspects of the presently disclosed subject matter, independently or in various combinations thereof:

The support pots are rotational about a longitudinal axis thereof, during the course of folding and unfolding the wheelchair.

The head support unit can be detachably attachable over the top portions of the support posts.

The head support unit can comprise: a head support body configured with a front portion to which a head restraint is attachable; a right attachment element and a left attachment element configured for articulation with said right support post and said left support post, respectively, said right attachment element and said left attachment element being disposed at opposite sides of the head support body; and an adjustment mechanism configured for selectively adjusting the position of the right attachment element and the left attachment element with respect to each other, at least from an extended position towards a retracted position.

According to a particular example, the adjustment mechanism can be formed as one or more tensioning straps interconnecting the right attachment element and said left attachment element. Tensioning the straps can cause the right attachment element and said left attachment element to approach each other, thereby adjusting their position towards their retracted position.

The back portion of the head restraint can be integral with the head support unit.

The support posts can be height adjustable, so as to adjust the height at which the head restraint extends with respect to the backrest of the wheelchair.

The support posts can be height adjustable by a telescopic arrangement comprising two or more support posts axially displaceable and arrested by a height fixating mechanism.

The height fixating mechanism can be a snap lock fastener.

The height fixating mechanism can be a bolt fastener.

The support posts can be height adjustable by a fastener arrangement slidingly attaching a support post to a respective side frame of the wheelchair.

The support posts can be height adjustable by a combined height adjusting mechanism comprising a telescopic assembly and a fastener arrangement associated with the side frames.

The top bar and the bottom bar can integrally extend from respective ends of the posts.

The top bar and the bottom bar can be extendible so as to adjust to varying wheelchair width. Extension of the top bar and the bottom bar can be by a telescopic extension mechanism.

Pivotal articulation of a left bar member and a right bar member can be facilitated through a safety lock, whereby unlocking is required prior to pivotal displacement of the bar members.

One or more intermediate bars can extend between the support posts, each of said intermediate bars comprising a left bar member and a right bar member, respectively.

The bottom bar can assist in folding the wheelchair upon pushing at the pivotal articulation in a folding direction, so as to collapse the bottom bar.

The modular head support assembly can be configured as an add-on assembly for mounting on a wheelchair, or pre-fitted on a wheelchair.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
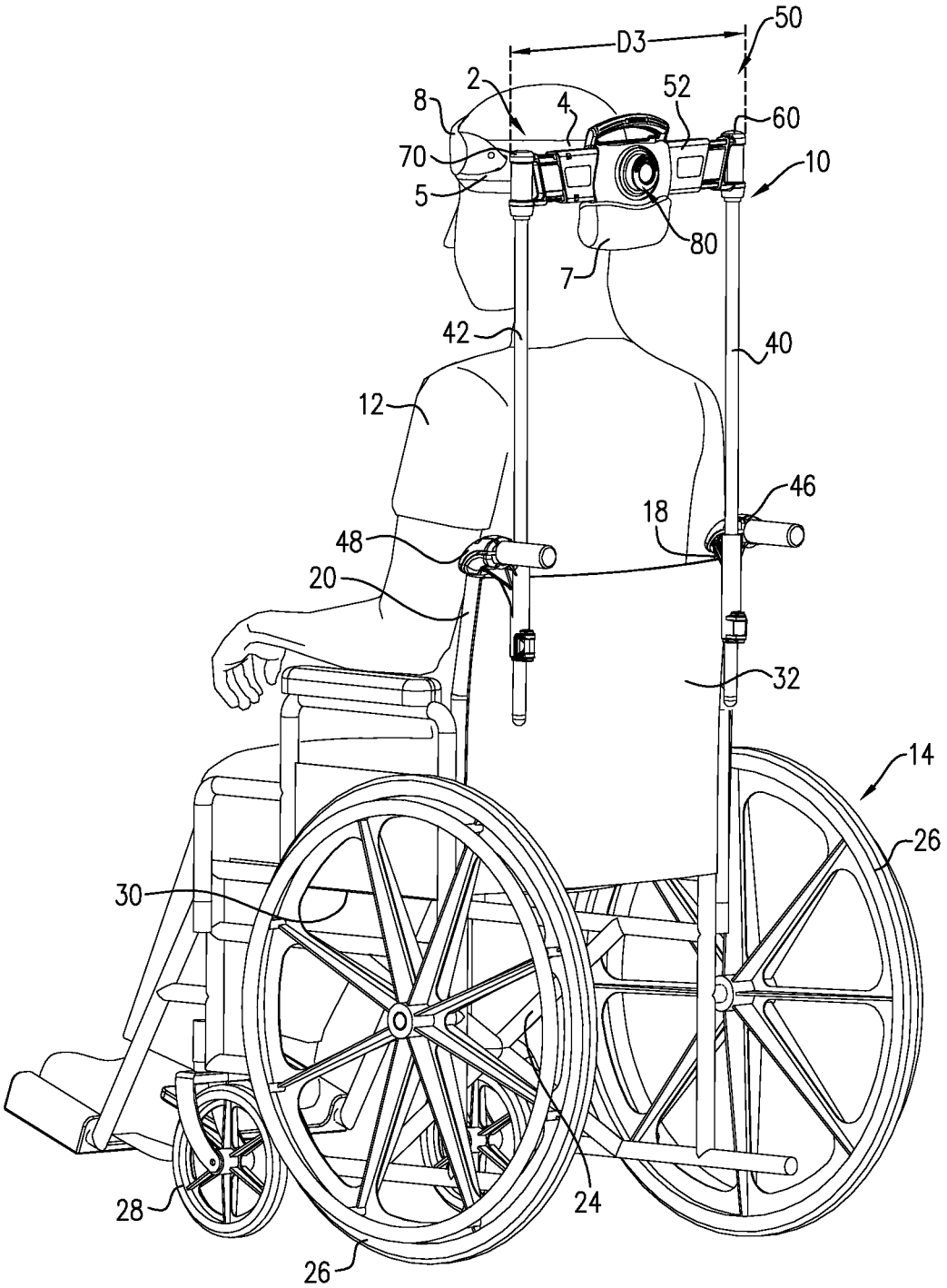
FIG. 1A illustrates a rear perspective view of a foldable wheelchair fitted with a modular head support assembly fitted with a head support unit with its right attachment element and left attachment element at an intermediate position, according to one example of the presently disclosed subject matter.

Attention is first made to FIGS. 1 to 6B of the drawings, directed to a first example of head support assembly according to the present disclosure, generally designated 10, mounted on a seat in the form of a generic type wheelchair, generally designated 14.

The wheelchair 14 is a collapsible wheelchair of the type comprising a right side frame 18 and a left side frame 20 articulated to one another by a collapsible X-shaped cross-frame 24, each side frame mounted over a large rear wheel 26 and a front caster wheel 28, with a foldable seat 30 and a foldable backrest 32 extending between the right side frame 18 and the left side frame 20. The wheelchair 14 is collapsible between a collapsed position (shown in FIG. 1C) and a deployed position (shown in FIGS. 1A and 1B).

Whilst a specific wheelchair is illustrated in the annexed drawings, it is appreciated that other types and shapes of wheelchairs can be used as well.

The head support assembly 10 is a modular system that can be configured as an add-on assembly for mounting on a wheelchair, or pre-fitted on a wheelchair.

In the examples of FIGS. 1 to 6B, the head support assembly 10 comprises a pair of support posts, namely a right support post 40 and a left support post 42, configured for attaching to the right side frame 18 by a right coupler unit 46, and to the left side frame 20 by a left coupler unit 48, respectively. The right coupler unit 46 and the left coupler unit 48 are configured for facilitating sliding displacement of the right support post 40 left support post 42 therein between an upper position shown in FIG. 1A and a lower position shown in FIGS. 1B and 1C, and for fixing the right and left support posts 40 and 42 at any position between the upper position and the lower position.

The head support assembly 10 further comprises a head support unit 50 having a support body 52 with a front portion 53, a rear portion 54, a right opening 55, a left opening 56, and a tunnel 57 extending between the right opening 55 and the left opening 56 along a longitudinal axis X. The head support unit 50 is configured for providing support for a head of a user 12 seated on the wheelchair 14. Since the head support unit 50 is not foldable, it first has to be detached from the right and left support posts 40 and 42 bringing the wheelchair 14 to its collapsed position shown in FIG. 1C.

Figure 1B:
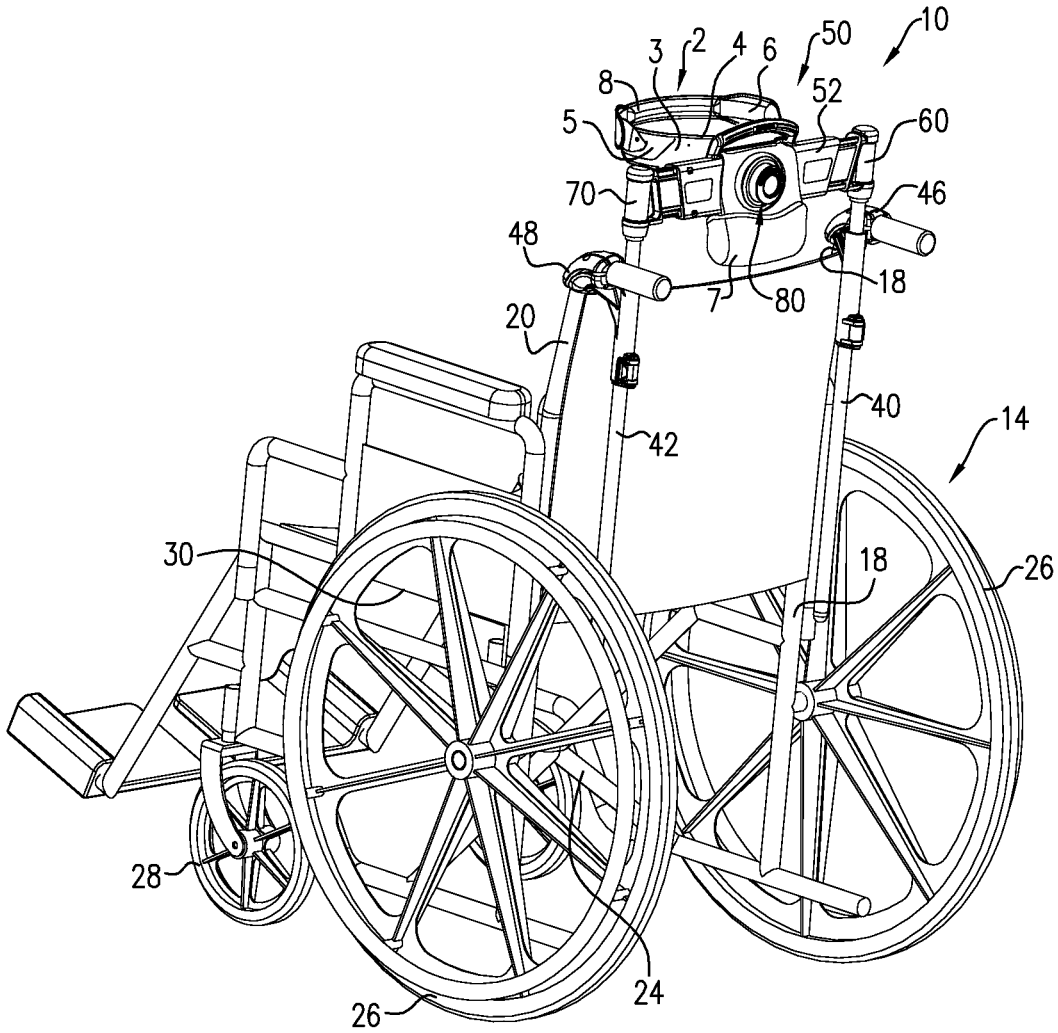
FIG. 1B illustrates the wheelchair of FIG. 1A with the head support assembly at a position lower than in FIG. 1A.
Figure 1C:
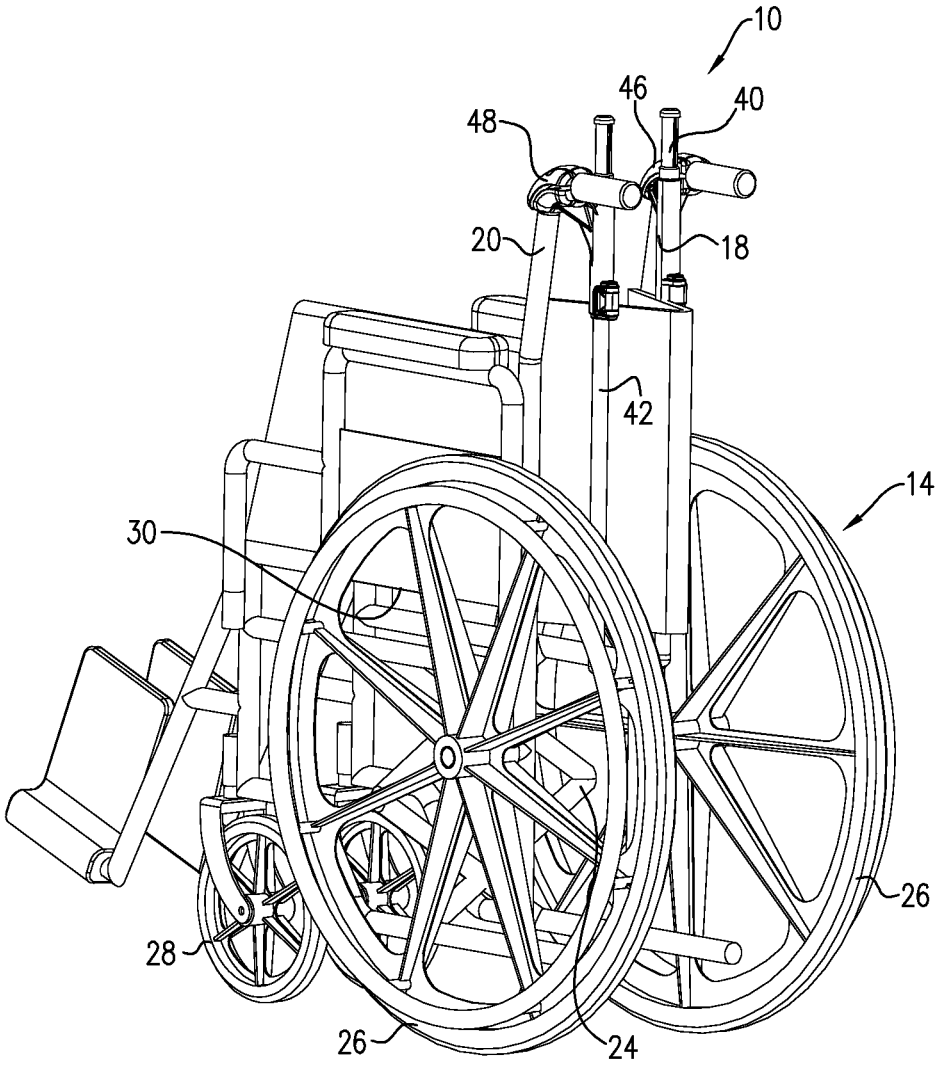
FIG. 1C illustrates the wheelchair of FIG. 1B at a collapsed position, with the support unit removed.

As shown in FIGS. 1A and 1B, a head restraint 2 is attached to the support body 52 and is disposed in front of the front portion 53. The head restraint 2 is configured for providing improved head and neck support to the user 12 while seated in the wheelchair 14, e.g., in case the user falls asleep or in case of an individual with physical disorders. More particularly, the head restraint 2 is configured for preventing the user's head from falling forward, and furthermore, for preventing the user's head from tilting to the left or the right side. This provides comfortable and stable support of the user's head while sitting on the wheelchair 14.

According to the particular example of FIGS. 1A and 1B, the head restraint 2 is the one disclosed in U.S. Pat. No. 9,566,885, the content of which is incorporated herein by reference. The head restraint 2 comprise: a headrest member 3 configured with a back portion 4 and two side portions 5 and 6 extending therefrom. The side portions 5 and 6 are foldable with respect to the back portion 4 so as to allow the headrest member to assume a first state in which the side portions 5 and 6 are spaced from each other at a first extent and a second state in which the side portions 5 and 6 are spaced from each other to a second extent which is smaller than the first extent. The head restraint 2 further comprises a mounting arrangement 7 including a hook and pile fastener (Velcro™) for detachably attaching the head restraint 2 to the support body 52. The head restraint 2 further comprises a restraining member 8 pivotally articulated to the side portions 5 and 6 for rotation at least between an upward position and a downward position, wherein displacement of the restraining member 8 between its upward position (not shown) and its downward position (shown in FIGS. 1A and 1B) is configured to cause the headrest member 3 to assume its first and second states, respectively. In use, when the user's head is positioned at the head restraint 2, the restraining member 8 at its upward position can be located substantially above the use's head, and in its downward position, the restraining member 8 is located in front of the user's forehead.

The head support unit 50 comprises a right attachment element 60 and a left attachment element 70 configured for articulation at top portions of the right support post 40 and the left support post 42, respectively. The right attachment element 60 and the left attachment element 70 are disposed at opposite sides of the support body 52. The head support unit 50 further comprises an adjustment mechanism 80 configured for selectively adjusting and fixing the position of the right attachment element 60 and the left attachment element 70 with respect to each other between an extended position (shown in FIGS. 5A and 5B) and a retracted position (shown in FIGS. 3A to 4C).

The adjustment of the position of the right attachment element 60 and the left attachment element 70 is performed by linearly displacing to and from each other along the longitudinal axis X extending along the support body 52.

Figure 2:
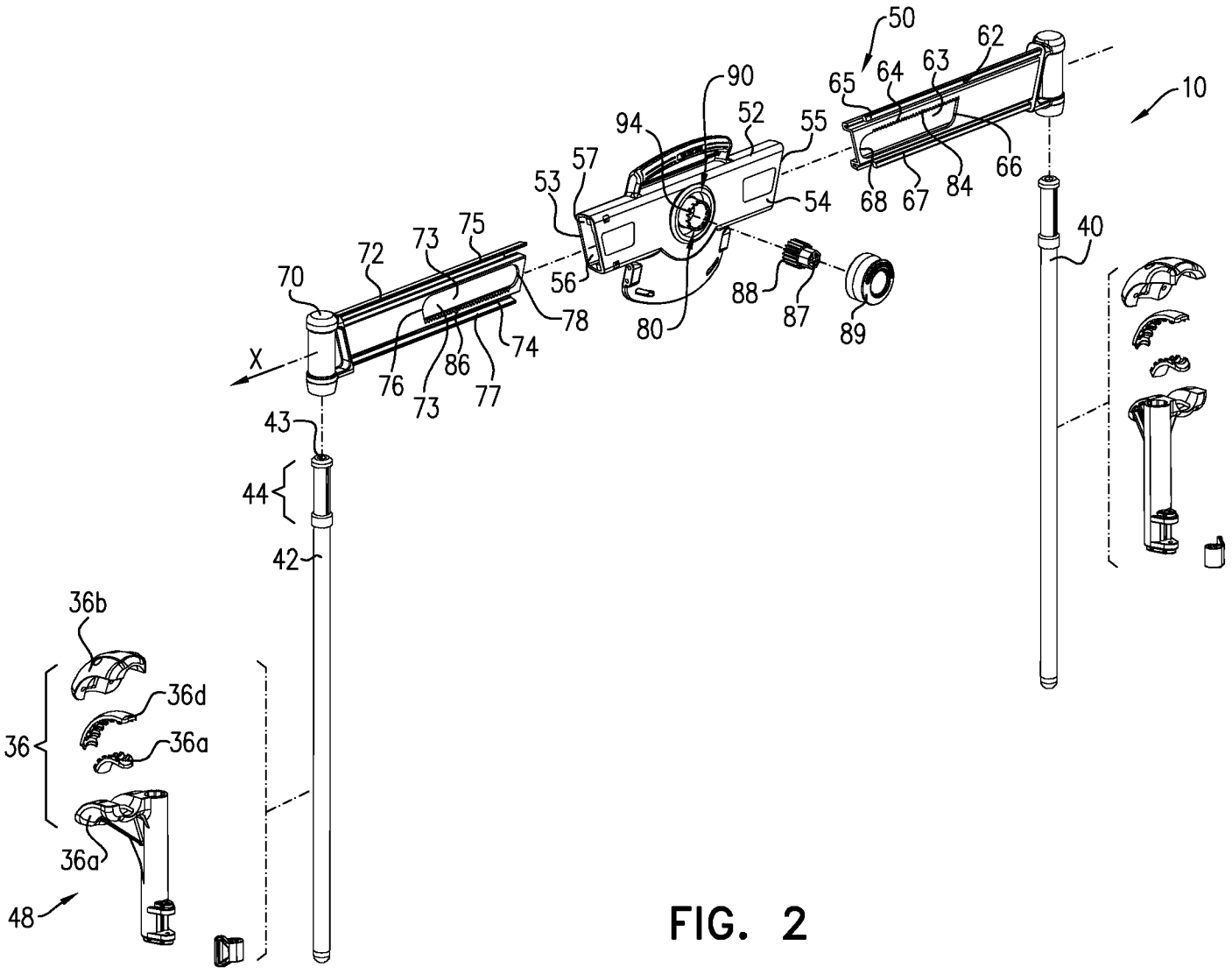
FIG. 2 is an exploded view of the head support assembly of FIG. 1A.

As shown in FIGS. 1A to 2, the right support post 40 and the left support post 42 extend vertically upwards in parallel to each other, defining a certain distance therebetween. When the right support post 40 and the left support post 42 are attached to the right and left side frame members 18 and 20, the distance therebetween is dictated by the width of the wheelchair 14, and in particular, by the structure and the distance between the right and left side frame members 18 and 20 of the wheelchair 14. This distance can change from one seat to another, or be dependent on the locations at which the right and left posts are articulated to the side frame of a particular seat. Thus, the right attachment element 60 and the left attachment element 70 are adjustable with respect to each other in order to detachably attach the head support unit 50 to the right and left support posts 40 and 42 and to fixedly fit the distance therebetween and respectively between right and left side frame members 18 and 20. This adjustment enables the right attachment element 60 and the left attachment element 70 to fixedly assume any one intermediate position from a plurality of intermediate positions between the extended position and the retracted position. In the example of FIGS. 1A and 1B, the right attachment element 60 and the left attachment element 70 are fixedly adjusted to an intermediate position which fits the distance between the right support post 40 and the left support post 42, dictated by the distance between the right and left side frames 18 and 20 at the deployed position of the wheelchair 14.

Reference is now made particularly to FIGS. 2 to 5B, illustrating the head support assembly, and different parts thereof. As mentioned above, the right attachment element 60 and the left attachment element 70 are adjustable between the extended position (shown in FIGS. 5A and 5B) and the retracted position (shown in FIGS. 3A to 4C) by displacing them along the longitudinal axis, so that at the retracted position, the distance between the right attachment element 60 and the left attachment element 70 is a minimal first distance D1, and at the extended position, the distance between the right attachment element 60 and the left attachment element 70 is a maximal second distance D2 which is greater than the first distance D1. As shown in FIGS. 3A and 3B, at the retracted position, the right attachment element 60 and the left attachment element 70 are adjacently positioned to opposite lateral sides of the head support body 52. At the intermediate position, the right attachment element 60 and the left attachment element 70 shown in FIGS. 1A and 1B, are spaced from each other to a third distance D3 which is greater than D1 and smaller than D2.

The adjustment mechanism 80 extends at least partially within the support body 52 and is configured to simultaneously displace the right attachment element 60 and the left attachment element 70 with respect to each other and with respect to the head support body 52. The simultaneous adjustment of the position of the right attachment element 60 and the left attachment element 70 is such that upon operation of the adjustment mechanism 80, the right attachment element 60 and the left attachment element 70 are displaced at the same distance. Moreover, the head support body 52 is symmetrical and the right attachment element 60 and the left attachment element 70 are disposed at equal distances from the center thereof at their various positions between the extended position and the retracted position. The adjustment mechanism 80 is operable by a user to increase or decrease the distance between the right attachment element 60 to the left attachment element 70, so that a single operation of the user adjusts and displaces both of the right attachment element 60 and the left attachment element 70, either towards the extended position and/or towards the retracted position.

As sown in FIG. 2, the right attachment element 60 and the left attachment element 70 are connected at opposite sides of the head support body 52 via a right extending element 62 and a left extending element 72, respectively, both slidable within the tunnel 57 and constituting part of the adjustment mechanism 80. The adjustment mechanism 80 is configured to displace and fix the right attachment element 60 and the left attachment element 70 at a plurality of positions by displacing and fixing the right extending element 62 and the left extending element 72 with respect to the head support body 52.

The right extending element 62 comprises a top and a bottom right slide members 65 and 67 and the left extending element 72 comprises a top and a bottom left slide members 75 and 77 slidably secured to the top and the bottom right slide members 65 and 67. The tunnel 57 has a complementary shape to the shape of the right extending element 62 and the left extending element 72 slidably secured together.

The right extending element 62 comprises a right elongate opening 63 formed therein with a right upper rim 64 having a right drive element in the form of teeth extending therefrom and constituting an upper rack 84.

The left extending element 72 comprises a left elongate opening 73 formed therein with a left lower rim 74 having a left drive element in the form of teeth extending therefrom and constituting a lower rack 86. The adjustment mechanism 80 comprises the upper rack 84, the lower rack 86, and a driving gear 87 comprising a driving portion in the form of a pinion 88 engaged with both of the upper rack 84 and the lower rack 86 and extending through the right elongate opening 63 and the left elongate opening 73.

The right elongate opening 63 further comprises right distal rim 66 and a right proximal rim 68, with the upper rack 84 extending therebetween. The left elongate opening 73 further comprises a left distal rim 76 and a left proximal rim 78, with the lower rack 86 extending therebetween.

The right and left distal rims 66 and 76 are situated closest to their respective attachment elements, and are configured to determine the retracted position (shown in FIG. 3B), at which the pinion 88 engages the distal rims 66 and 76, thereby delimiting further displacement of both the right and left attachment elements 60 and 70. Also, at the extended position (shown in FIG. 5B) the pinion 88 engages the right proximal rim 68 and the left proximal rim 78 delimiting further displacement of both the right and left attachment elements 60 and 70.

The driving gear 87 comprises a rotatable handle 89 for configured to be gripped by a user and rotated towards a clockwise direction for adjustment of the right and left attachment elements 60 and 70 from the retracted position towards the extended position, and rotated towards a counterclockwise direction for adjustment of the right and left attachment elements 60 and 70 from the extended position towards the retracted position.

As mentioned above, the adjustment mechanism 80 is further configured for fixing the position of the right attachment element 60 and the left attachment element 70 with respect to each other. The adjustment mechanism 80 thus comprises a fixing mechanism 90 configured to fix the right attachment element 60 and the left attachment element 70 at any one intermediate position from a plurality of intermediate positions between the extended position and the retracted position.

The fixing mechanism has a latch portion 92 (shown in FIGS. 3C, 3D and 4C) in the form of teeth formed in the handle 89, selectively engageable with a locking portion 94 of the head support body 52 (shown in FIGS. 2, 3C, 3D and 4C) formed as depressions. The teeth of the locking portion 94 are designed in a complementary manner to the depressions of the latch portion 92, such that when the locking portion 94 is displaced into engagement with the latch portion 92, the locking portion 94 is flush with the latch portion 92 and is prevented from movement. This state of the fixing mechanism 90 is shown in FIGS. 3A to 3D and 5A to 5B, and is considered as a locked state of the fixing mechanism 90. The number of teeth and depressions and the spacing therebetween determines the number of the discrete positions (e.g., intermediate positions) and the difference between the positions.

Thus, the fixing mechanism 90 is configurable between:

a locked state (shown in FIGS. 3A to 3D and 5A to 5B), at which the latch portion 92 is engage with the locking portion 94, so as to prevent the driving gear from rotation, and fixing the respect position of the right and left attachment elements 60 and 70; and an unlocked state (shown in FIGS. 4A to 4C), at which the latch portion 92 is disengaged from the locking portion 94, so as to enable rotation of the driving gear 87.

The fixing mechanism 90 is configurable between the locked state and the unlocked state by being slidably displacing the driving gear 87 towards and away from the head support body 52 perpendicularly to the longitudinal axis X, by pulling and pushing the handle 89 by the user, towards and away from the head support body 52.

Figure 3A:
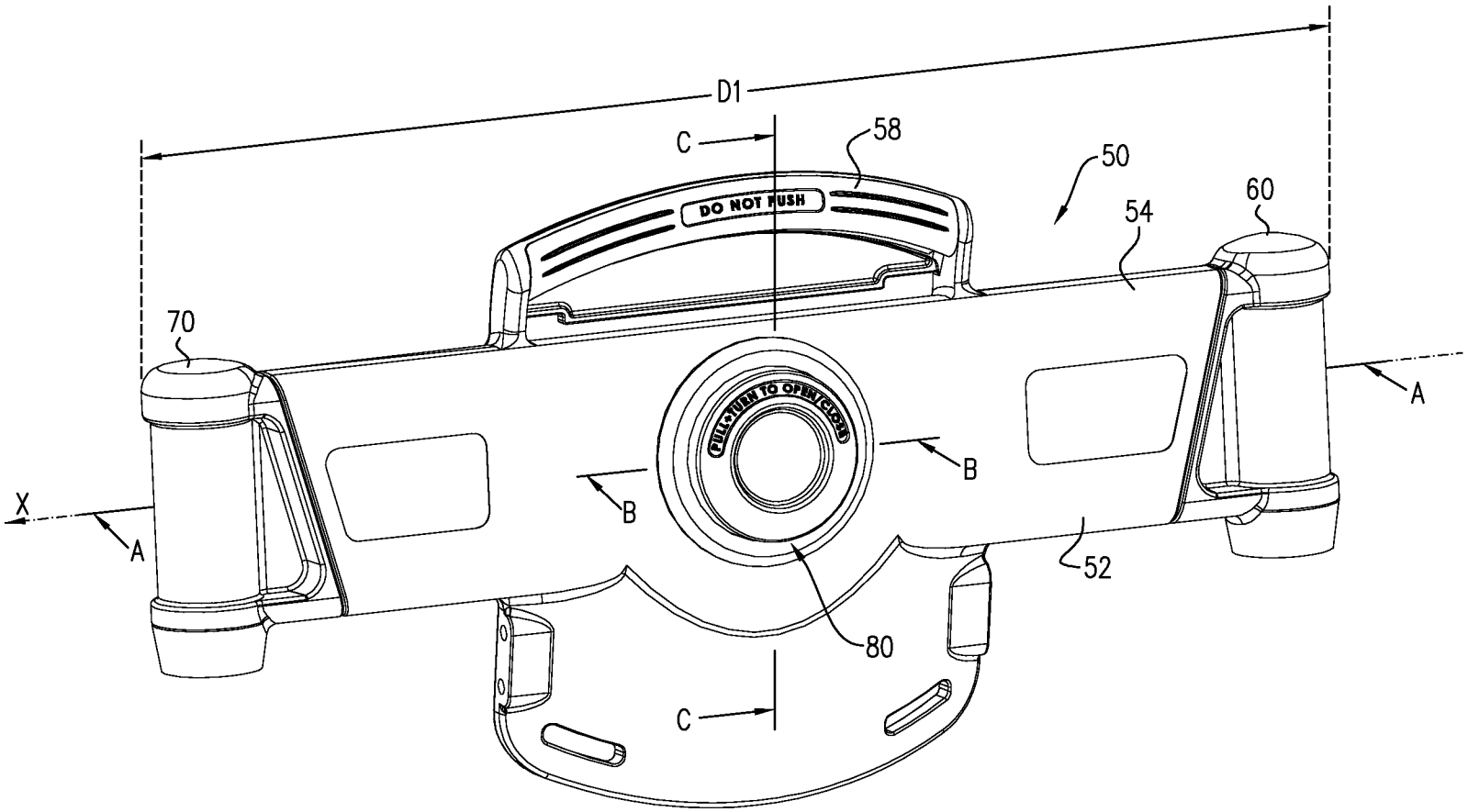
FIG. 3A illustrates a rear perspective view of a support unit of the head support assembly of FIG. 1A, with its right attachment element and left attachment element at a retracted position, and with its driving gear at a locked state.
Figure 3B:
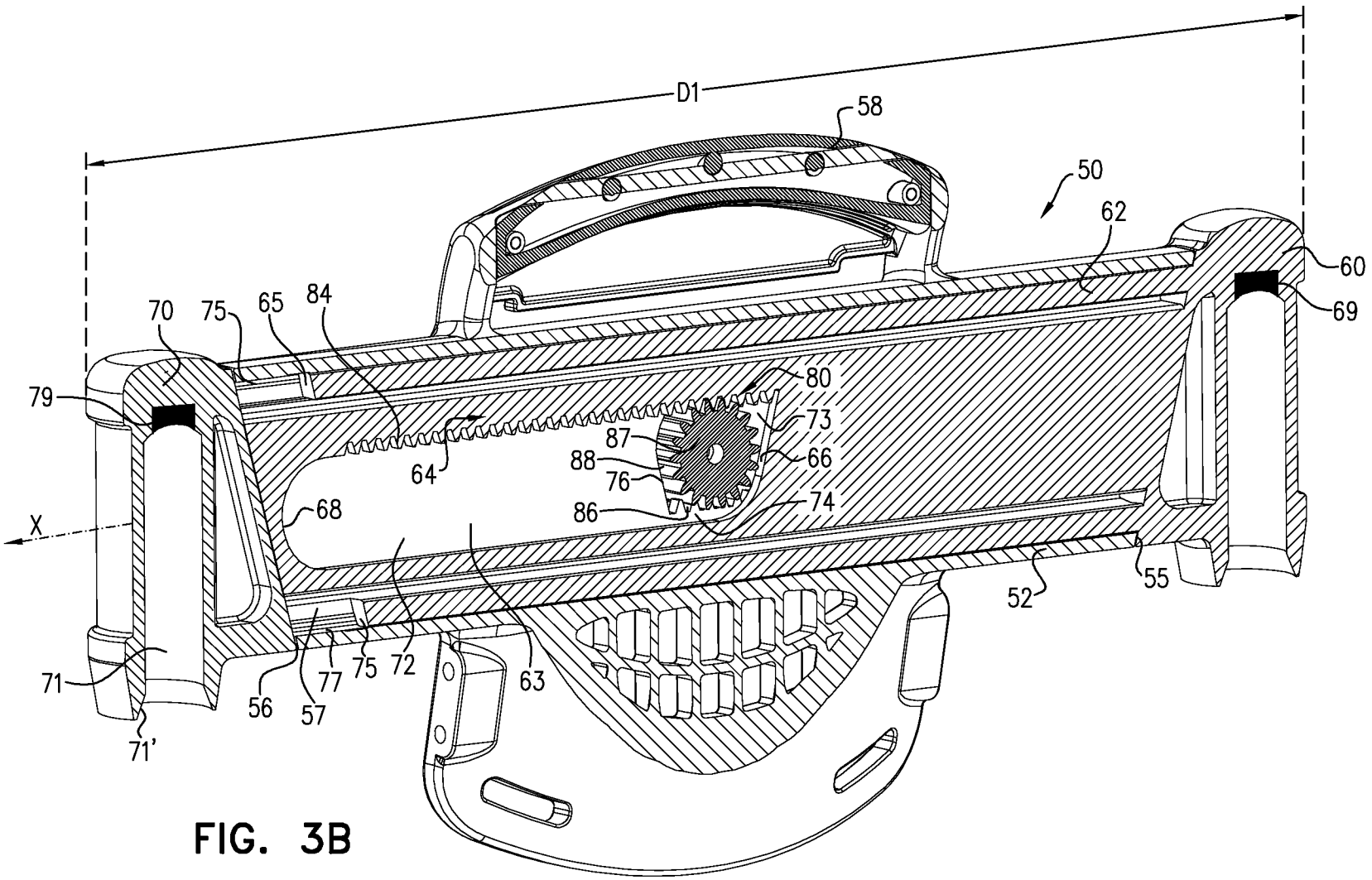
FIG. 3B is a cross-sectional view along line A-A in FIG. 3A.
Figure 3C:
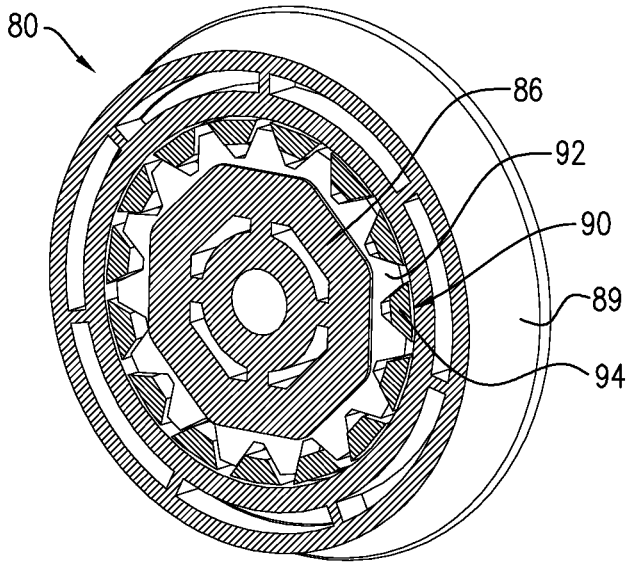
FIG. 3C is a cross-sectional view along line B-B in FIG. 3A.
Figure 3D:
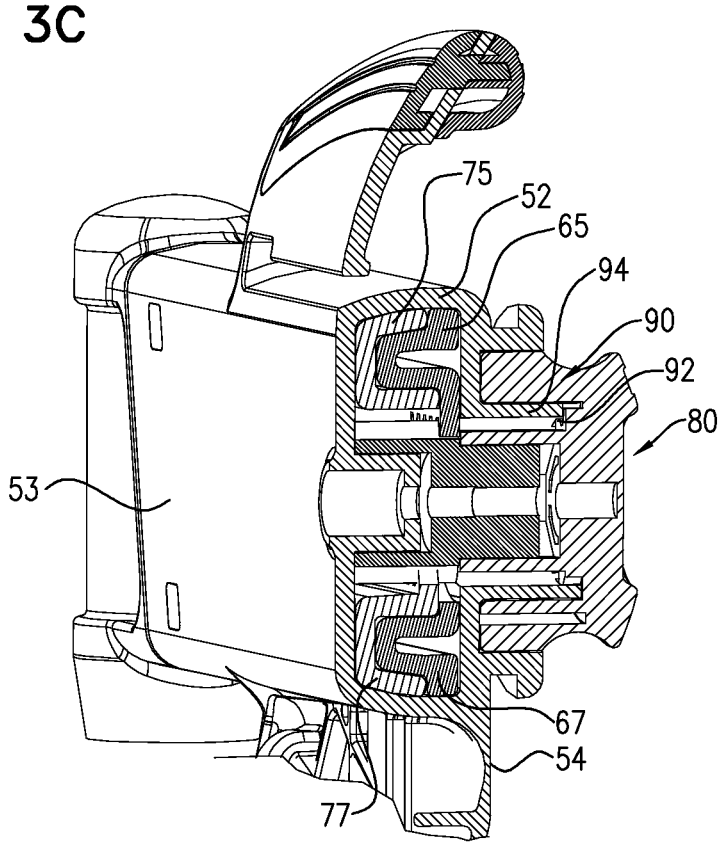
FIG. 3D is a cross-sectional view along line C-C in FIG. 3A.
Figure 4A:
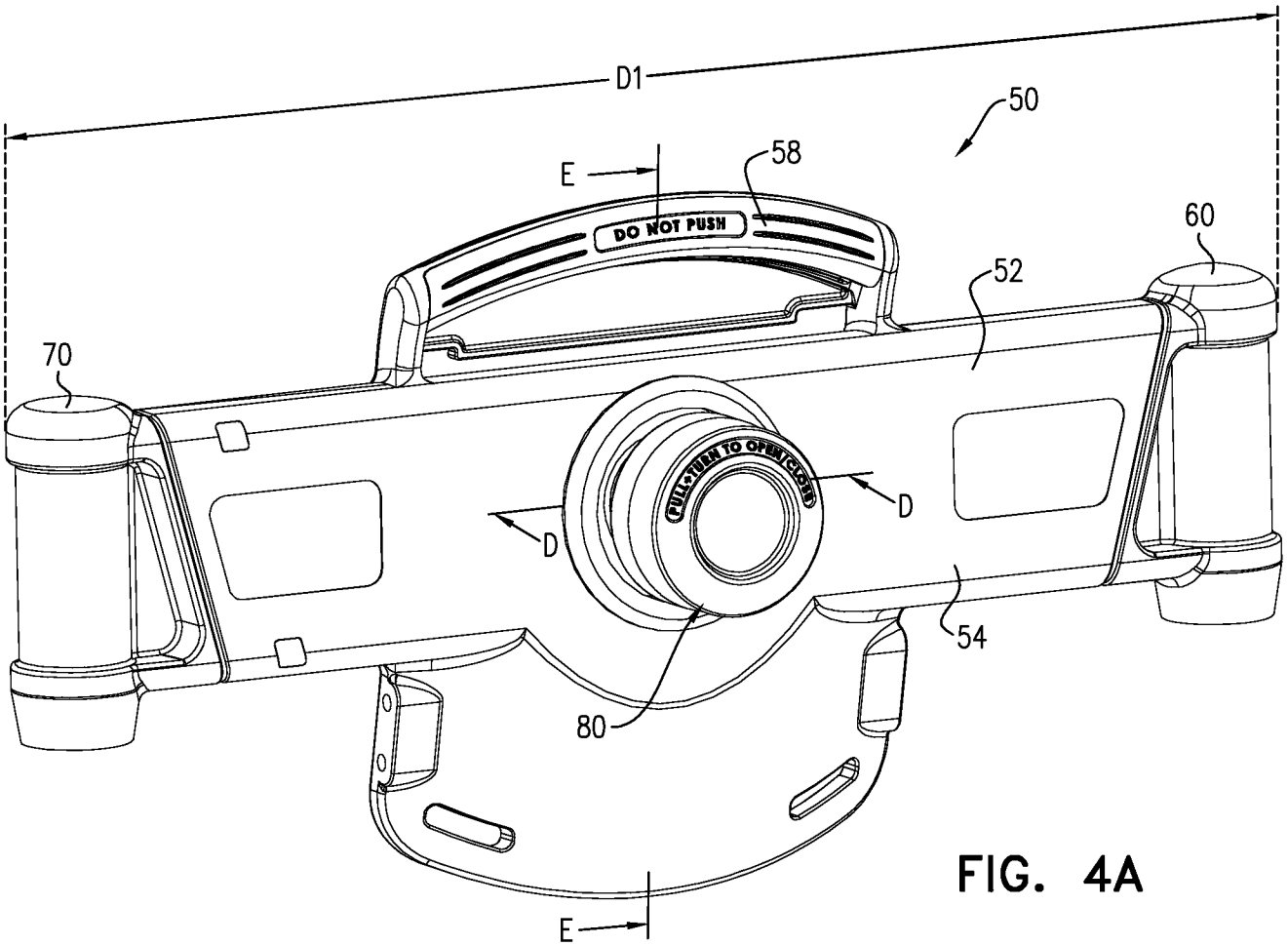
FIG. 4A illustrates the support unit of FIG. 3A, with the driving gear at an unlocked state.
Figure 4B:
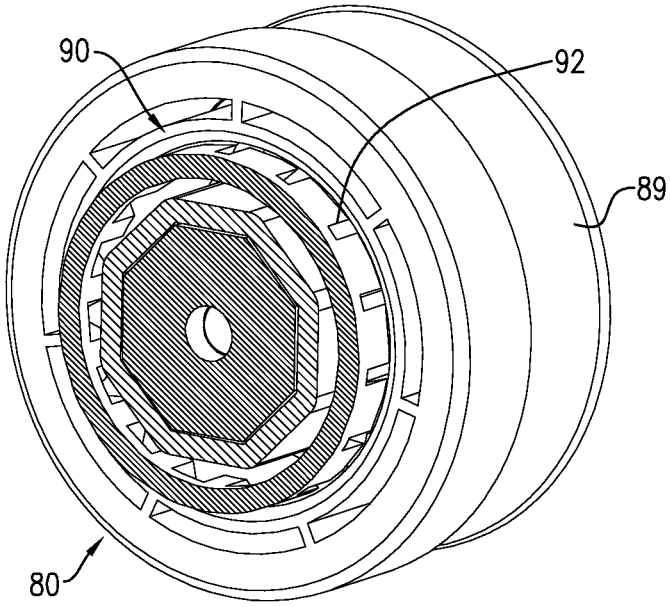
FIG. 4B is a cross-sectional view along line D-D in FIG. 4A.
Figure 4C:
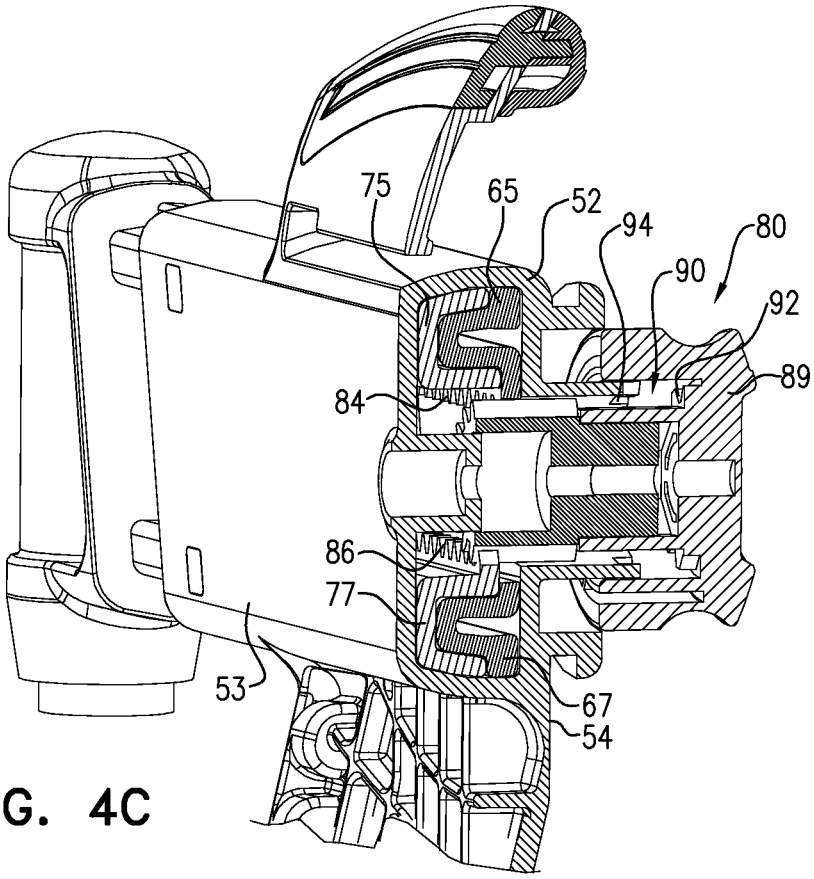
FIG. 4C is a cross-sectional view along line E-E in FIG. 4A.
Figure 5A:
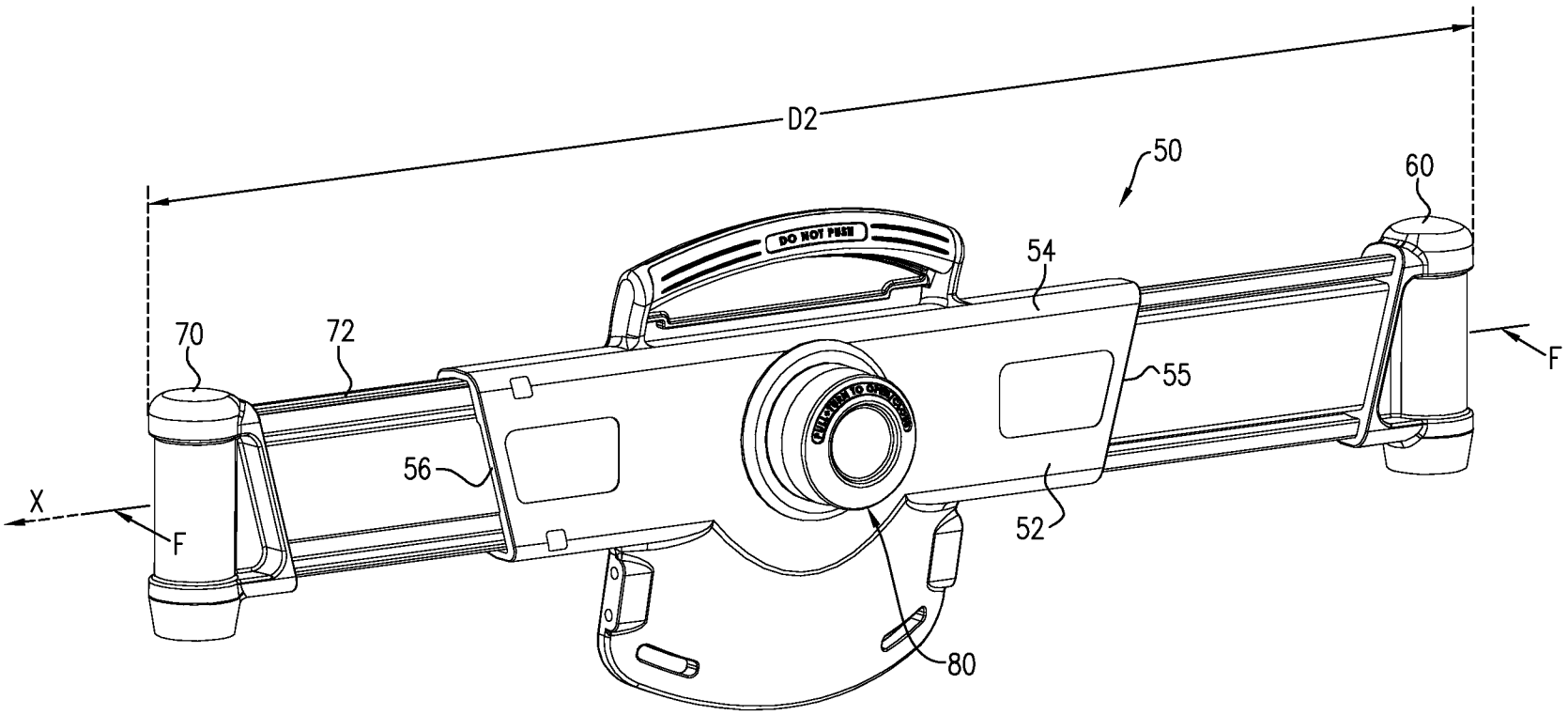
FIG. 5A illustrates a rear perspective view of a support unit of FIG. 3A, with its right attachment element and left attachment element at an extended position.
Figure 5B:
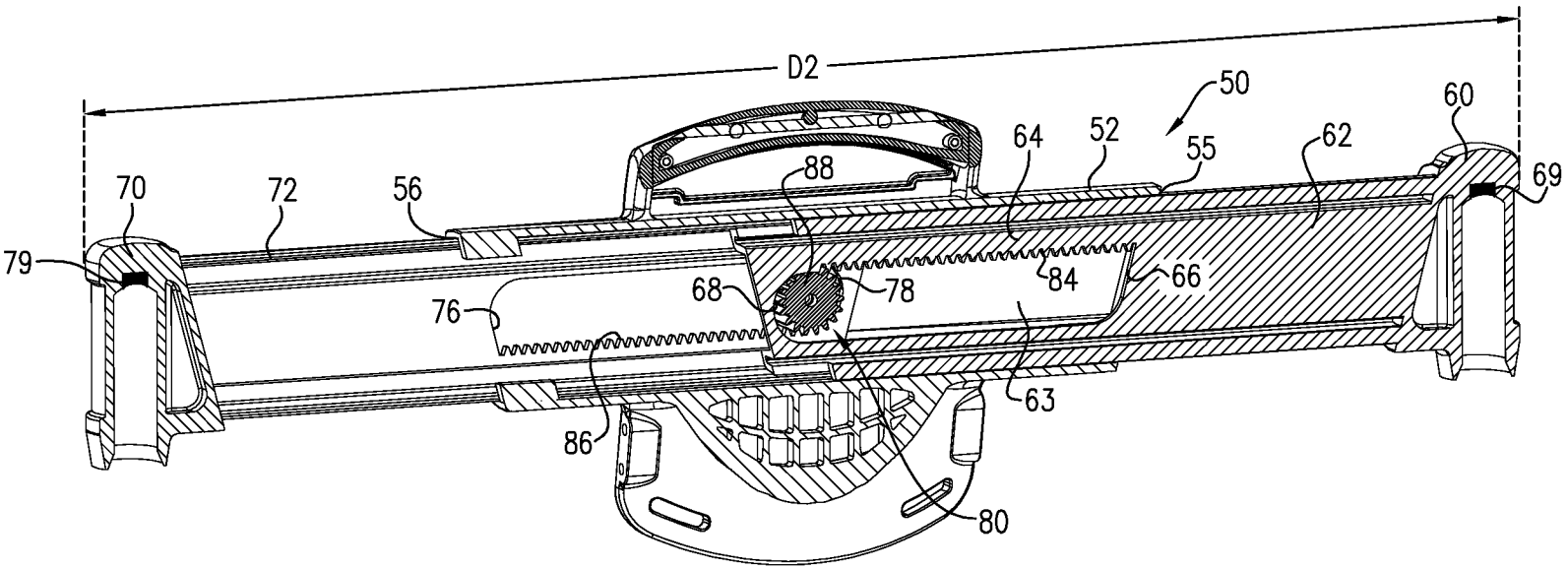
FIG. 5B is a cross-sectional view along line F-F in FIG. 5A.

For example, in order to displace the right attachment element 60 and the left attachment element 70 from their retracted position of FIG. 3A, at which the fixing mechanism 90 is at the locked state, the handle 89 has first to be pulled by the user away from the head support body 52. This causes the fixing mechanism 90 to assume its unlocked state, as shown in FIGS. 4A to 4C. Only at this unlocked states, the latch portion 92 is disengaged from the locking portion 94, and the user can rotate the handle 89 in the clockwise direction, so as to rotate the driving gear 87. During the rotation of the handle 89, the distance between the right attachment element 60 and the left attachment element 70 is decreased, and they pass through a plurality of intermediate positions. At any intermediate position, at which the wanted distance is obtained, the handle 89 is pushed towards the head support body 52, causing the fixing mechanism 90 to assume its locked state. FIGS. 5A and 5B shown the extended position of the right attachment element 60 and the left attachment element 70, as which the fixing mechanism 90 is at its locked state.

Reference is now made particularly to FIGS. 2, 3B, 6A and 6B in order to describe the structure of the left support post 42 and its articulation manner to the left attachment element 70 and to the left side frame 20 by the left coupler unit 48. Since the right support post 40 has the same structure and functionality, the description with respect to the left support post 42 is similarly relevant with respect to the right support post 40.

The left attachment element 70 comprises a mounting bore 71 configured for receiving therein a top section 44 of the left support post 42. The mounting bore 71 comprises a bore opening 71' formed at a bottom surface of the left attachment element and configured for receiving therethrough the top section 44. The left attachment element 70 comprises a securing element 79 in the form of a magnet disposed at an internal end of the mounting bore 71 for magnetically detachably attaching to a magnetically attractable member 43 of the left support post.

The left coupler unit 48 comprises: a support post receiving member 49 formed as a vertically positioned pipe for receiving therethrough the left support post 42 and facilitating sliding displacement of the left support post 42 in an up/down orientation; a mounting mechanism 36 attachable to the left side frame member 20; and a height fixing mechanism in the form of a lock fastener 38 configured for selectively arresting the left support post 42 with respect to the left support post receiving member 49. The lock fastener 38 is configured for allowing and preventing elevation of the left support post 42 at any desired elevation, between an upward position (FIG. 1A and a downward position (FIG. 1B), whereby any intermediate elevation can be set too. The support posts can thus be height adjustable, so as to adjust the height at which the support unit extends with respect to the backrest of the wheelchair 14.

The mounting mechanism 36 comprises a first frame engaging section 36*a* and a complementary second frame engaging section 36*b* configured for tightly receiving therebetween the left side frame member 20. The first frame engaging section 36*a* and the second frame engaging section 36*b* is tightly attached to each other. Each one of the first frame engaging section 36*a* and the second frame engaging section 36*b* comprises a depression formed at a frame engaging side thereof, and a first and second elastomer unit 36*c* and 36*d* extending through the length of the depression. The first and second elastomer unit 36*c* and 36*d* are configured to enable the mounting mechanism 36 for receiving a diversely formed side frame member therebetween. The first and second elastomer unit 36*c* and 36*d* are configured to mediate different designs of the side frame members, so as to tightly receive the side frame member therebetween regardless of the design differences.

Figure 6B:
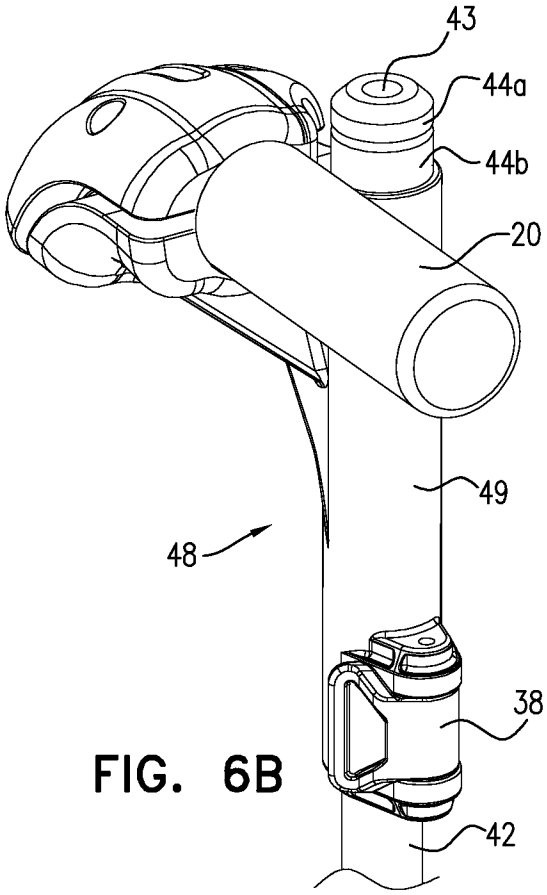
FIG. 6B illustrates the support post and the coupler unit of FIG. 6A, with the top section at lower position than in FIG. 6A.
Figure 6A:
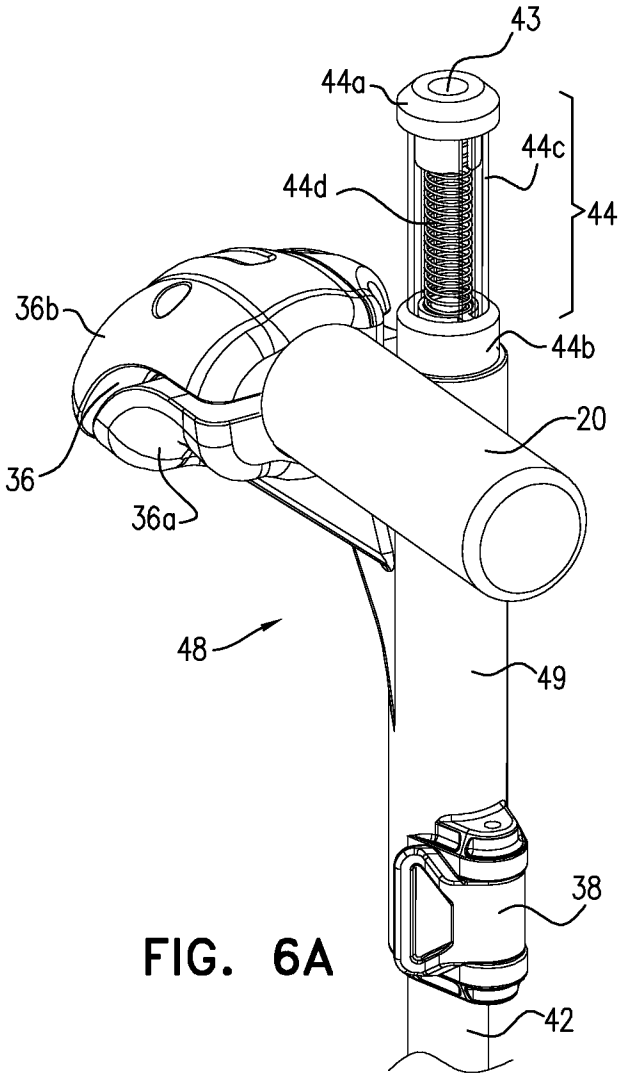
FIG. 6A illustrates a rear left perspective view of a support post and a coupler unit of the head support assembly of FIG. 1B, with a top section of the support post extending above the coupler unit.
Figure 7:
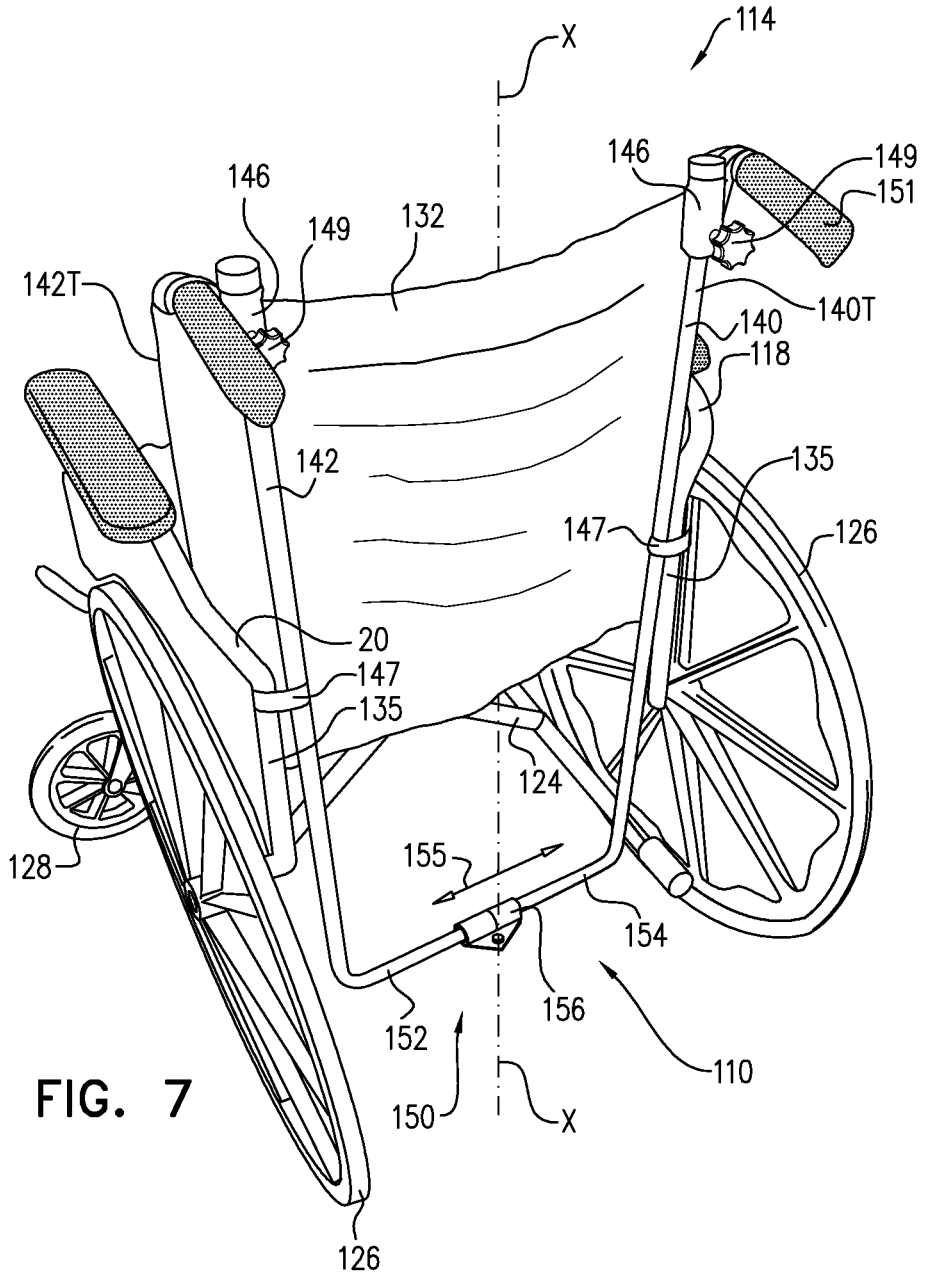
FIG. 7 illustrates a rear perspective view of a foldable wheelchair fitted with a modular head support assembly according to another example of the presently disclosed subject matter, with its support posts retracted and support unit removed.
Figure 8:
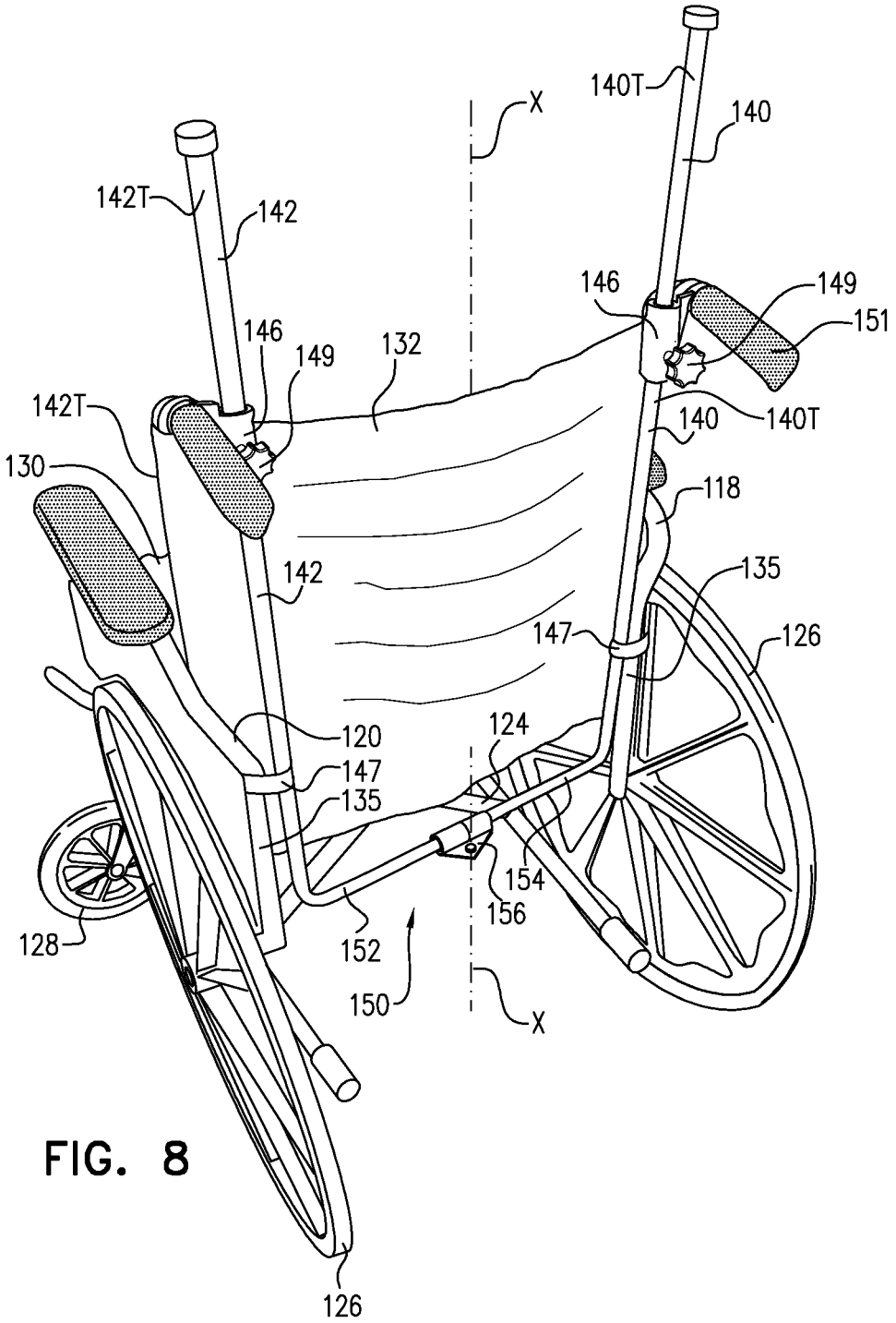
FIG. 8 is a rear perspective view of the wheelchair of FIG. 7, with the support posts projecting up.
Figure 9:
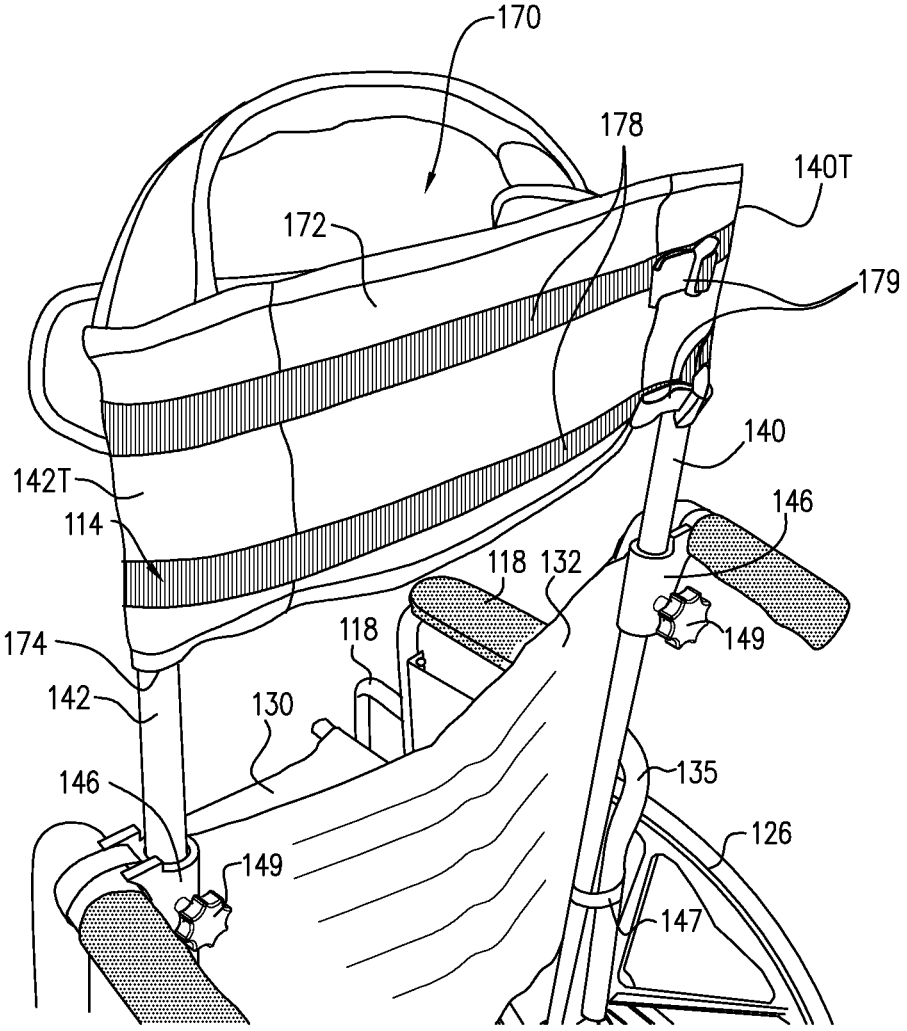
FIG. 9 is a rear perspective view of the wheelchair of FIG. 7, with the support unit mounted on the support posts.
Figure 10:
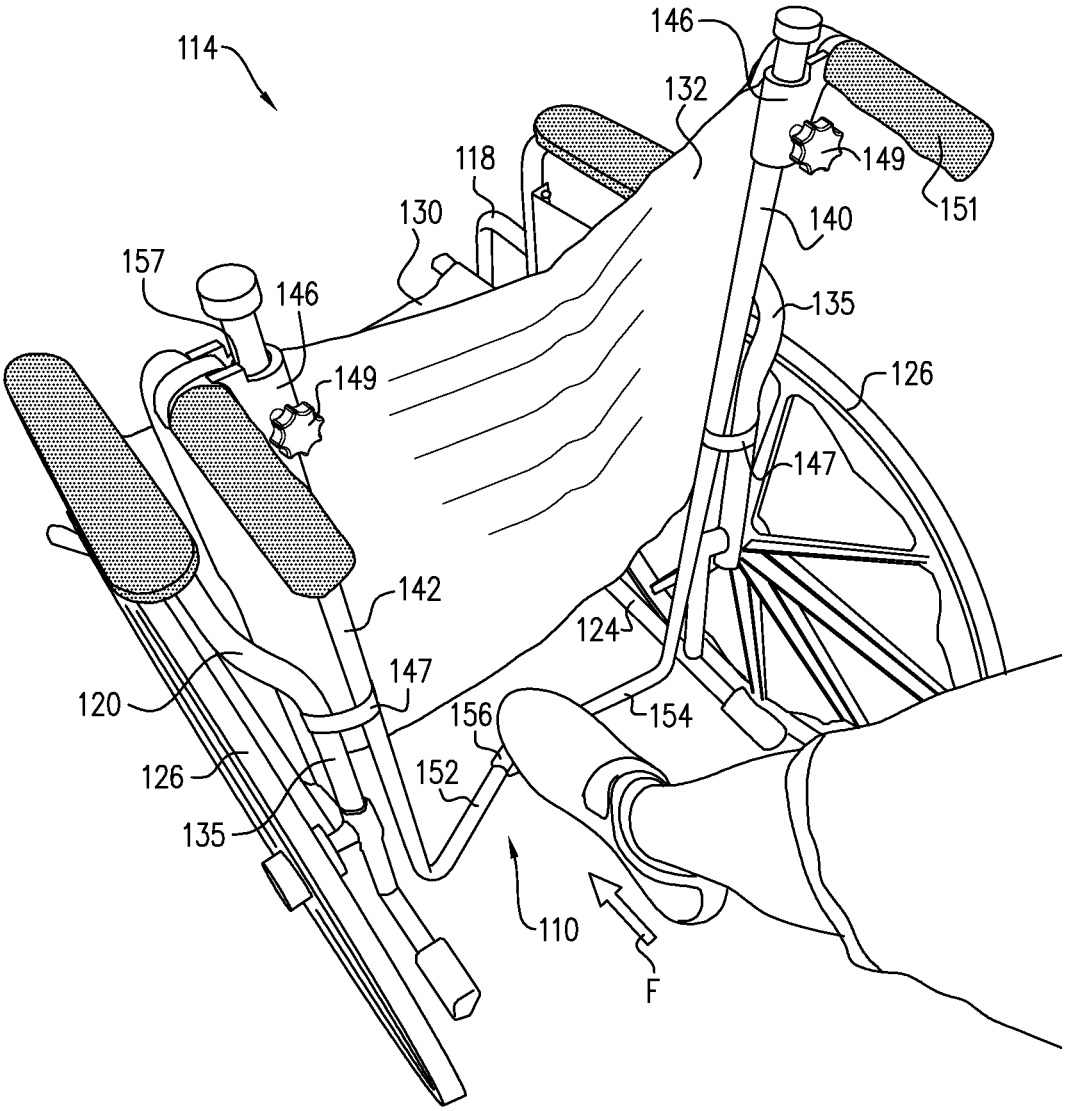
FIG. 10 illustrates a first step of folding the wheelchair of FIG. 7.
Figure 11A:
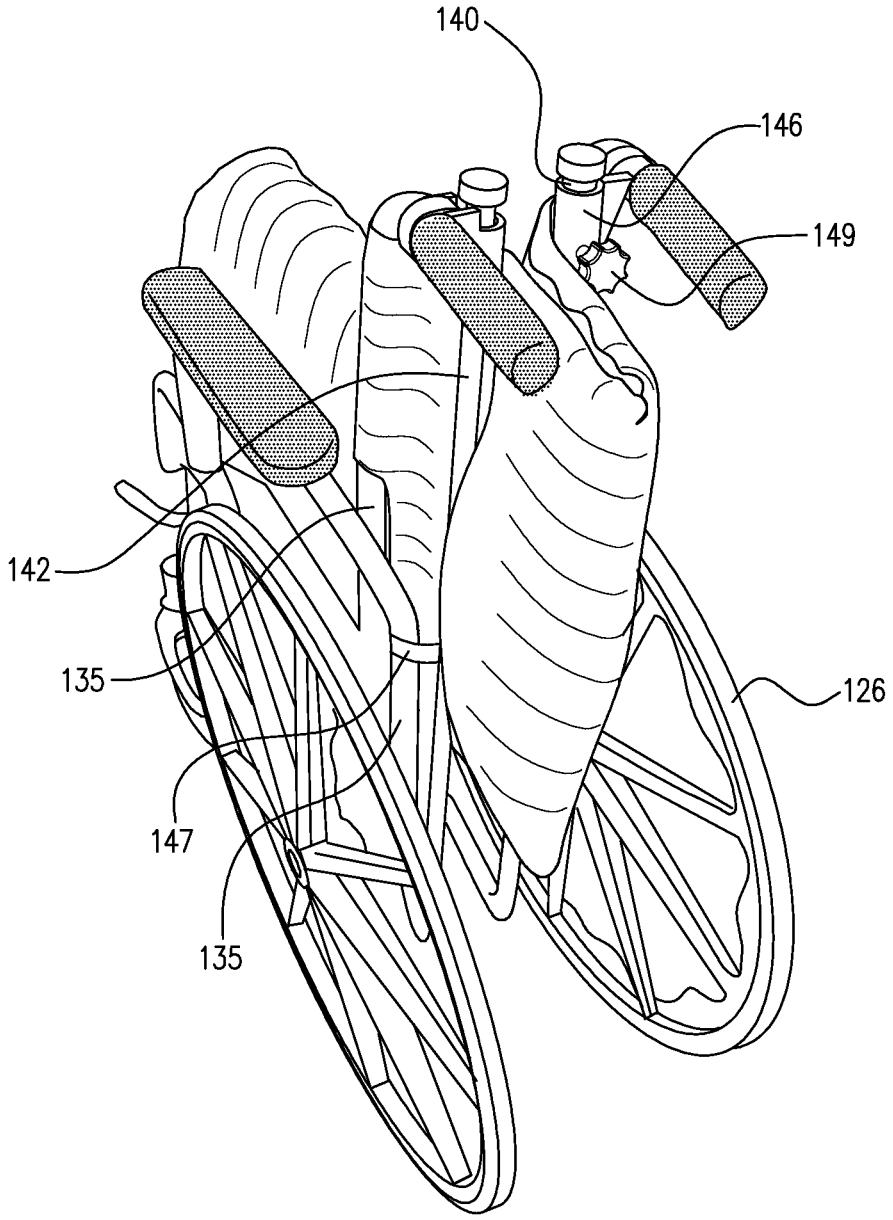
FIG. 11A illustrates the wheelchair of FIG. 7 at a folded position.
Figure 11B:
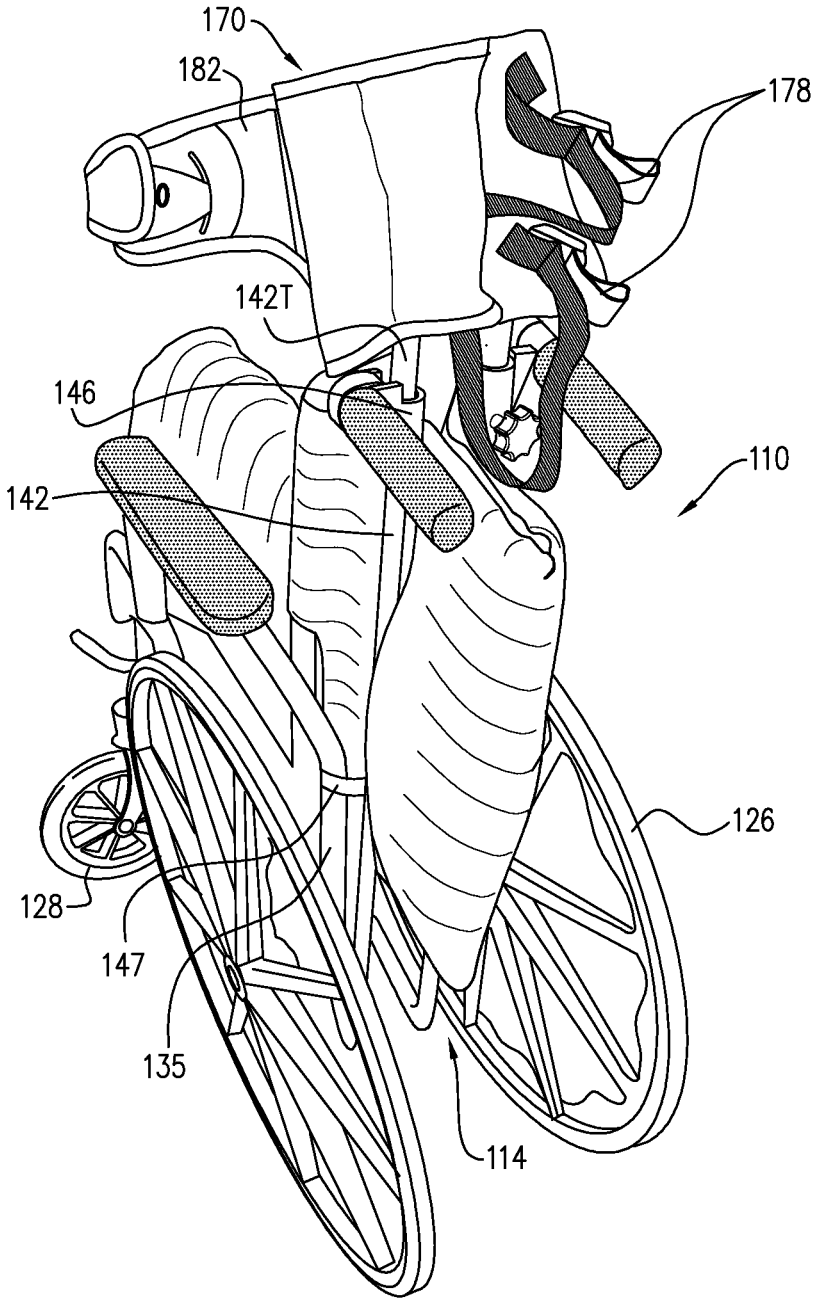
FIG. 11B illustrates the wheelchair of FIG. 9 at a folded position.

As shown in FIGS. 6A and 6B, the left support post comprises a shock absorber 33 formed at the top section 44. The shock absorber 33 is disposed within the top section 44 to which the left attachment element 40 is attachable. The shock absorber 33 is configured to be used to mitigate damages to the head support unit 50 attached thereon in case the right and left support posts 40 and 42 fall down fast. Additionally, the shock absorber 33 is configured to be used to substantially level the top section 44 of the left support post 42 with the left coupler unit 48, as shown in FIG. 6B.

The left shock absorber 33 comprises a spring mounting member 44*a* disposed within the upper part of the top section 44, an external stopper 44*b* wider than the left support post 42 and wider than the support post receiving member 49 and displaceable towards and from the spring mounting member 44*a* along a stopper track 44*c* disposed vertically below the spring mounting member 44*a*, and a spring 44*d* interconnecting the spring mounting member 44*a* and the external stopper 44*b*. Upon engagement of the external stopper 44*b* with the support post receiving member 49, the external stopper 44*b* cannot pass though the support post receiving member 49. This position is shown in FIG. 6A. Further pulling of the left support post 42 in the downward direction, causes the spring mounting member 44*a* to be displaced towards the external stopper 44*b* and to engage it. At this position, which is shown in FIG. 6B, the top section 44 does not extend above the left coupler unit 48. The spring 44*d* is configured for normally biasing the stopper 44*b* away from the spring mounting member 44*a* along the stopper track 44*c*. Thus, the stopper 44*b* is positioned by default at the bottom of the top section 44. For example, when the stopper 44*b* is being pushed upwards along the stopper track 44*c*, the spring applies compression forces on the stopper 44*b* entailing the stopper 44*b* to revert back to the bottom of the top section 44.

The stopper track 43*c* is disposed below the spring mounting member 44*a* and extends to a distance corresponding to the length of the left mounting bore 71. Thus, when the left support post 42 is inserted to the coupler unit at the position of FIG. 6A, the head support unit 50 can still be attached on the top section 44, which extends above the left coupler unit 48.

The head support body 52 comprises a handle 58, extending upwards and spaced from a top portion of the head support body 52, forming a gap therebetween. The gap is designed such that at least one upper strap of the head restraint 2 can extend through the gap for securing the head restraint 2 to the head support body 52.

The head support body 52 comprises a lower section having a plurality of lateral apertures 52' disposed thereon and to which a plurality of convenient devices are attachable. Such convenient devices can comprise articulating arms for supporting beverages and the like.

Attention is now made to FIGS. 7 to 13 and 16 of the drawings, directed to another example of wheelchair head support assembly according to the present disclosure, generally designated 110, mounted on a generic type wheelchair generally designated 114.

The wheelchair 114 is foldable wheelchair of the type comprising a right side frame 118 and a left side frame 120 articulated to one another by a collapsible X-shaped cross-frame 124, each side frame mounted over a large rear wheel 126 and a front caster wheel 128, with a foldable seat 130 and a foldable backrest 132 extending between the right side frame 118 and the left side frame 120. Each of the right side frame 118 and the left side frame 120 is configured with an upright rear bar 135.

Whilst a specific wheelchair is illustrated in the annexed drawings, it is appreciated that other types and shapes of wheelchairs can be used as well.

The head support assembly 110 is a modular system that can be configured as an add-on assembly for mounting on a wheelchair, or pre-fitted on a wheelchair.

In the first example, the head support assembly 110 comprises a pair of support posts, namely a right support post 140 and a left support post 142, each configured for attaching to a respective upright rear bar 135 of the wheelchair 114, by a coupler unit 146 articulated to the upright rear bar 135. The coupler unit 146 comprises a support post channel through which the respective support post is slidably displaceable in an up/down orientation. A secondary support unit 147 is configured below each coupler unit 146, slidingly accommodating a support post, wherein a set screw 149 is provided at coupler unit 146 for fixing elevation of the support posts at any desired elevation, between a fully retracted position (FIG. 7) and a fully extended position (FIG. 8), whereby any intermediate elevation can be set too.

It is however appreciated that the support posts are retained and articulated to the respective upright bars of the wheelchair at a fashion facilitation rotational displacement of the support posts about their longitudinal axis during folding the wheelchair. Accordingly, the coupler unit 146 and the secondary support unit 147 facilitate rotation of the support posts 140 there within.

As noted, the support posts are height adjustable by the set screw. However, according to another embodiment (not shown) the support posts can be preset at a fixed elevation above the back rest 132. According to yet an embodiment (not shown), elevation of the support posts can set by a telescopic arrangement comprising two or more support post segments axially displaceable and arrested by a height fixating mechanism. Likewise, the height fixating mechanism can be a snap lock fastener, or the support posts can be height adjustable by a combined height adjusting mechanism comprising a telescopic assembly and a fastener arrangement associated with the side frames.

It is appreciated that the coupler unit 146 and the secondary support unit 147 can be detachable attachable to the respective upright rear bars 135, for removal of the head support assembly 110. Alternatively, the head support assembly 110 can be removed from the wheelchair 114 by fully sliding out the right support post 140 and a left support post 142 and removing same.

The head support assembly 110 is further configured with a bottom bar 150 extending between respective bottom ends of the support posts 140 (imparting it a right angled U-like frame shape), the bottom bar 150 extending at a substantially right angle with respect to the support posts 140, and is configured with a left bar member 152 extending from a bottom of the left support post 142, and a right bar member 154 integrally extending from a bottom of the right support post 140, wherein the left bar member 152 and right bar member 154 are pivotally articulated to one another through a coupler member 156 with a pivot axis X extending substantially parallel to the support posts 140 and 142 (FIGS. 1 and 2). Noticeable, where the wheelchair is non-foldable, the bottom bar 150 can be a solid member. furthermore, the left bar member 152 and right bar member 154 can be articulated with the respective bottom left support post 142 and bottom of the right support post 140 (as opposed to being integral therewith).

The coupler member 156 can be configured with a locking mechanism to prevent unintended collapsing of the bottom bar 150, or it can be configured as a toggle type mechanism retaining it at the expanded position. However, it is advantageous that the coupler member 156 can be readily collapsed e.g. by a user's foot as exemplified by in FIG. 4, assisting in collapsing/folding of the wheelchair 114.

Also, the left bar member 152 and right bar member 154 of the bottom bar (and similarly of a top bar if provided) can be coaxially extendible (exemplified by arrow 155 in FIG. 7) so as to adjust to varying wheelchair width. Extension of the top bar and the bottom bar can be by a telescopic extension mechanism.

Figure 15A:
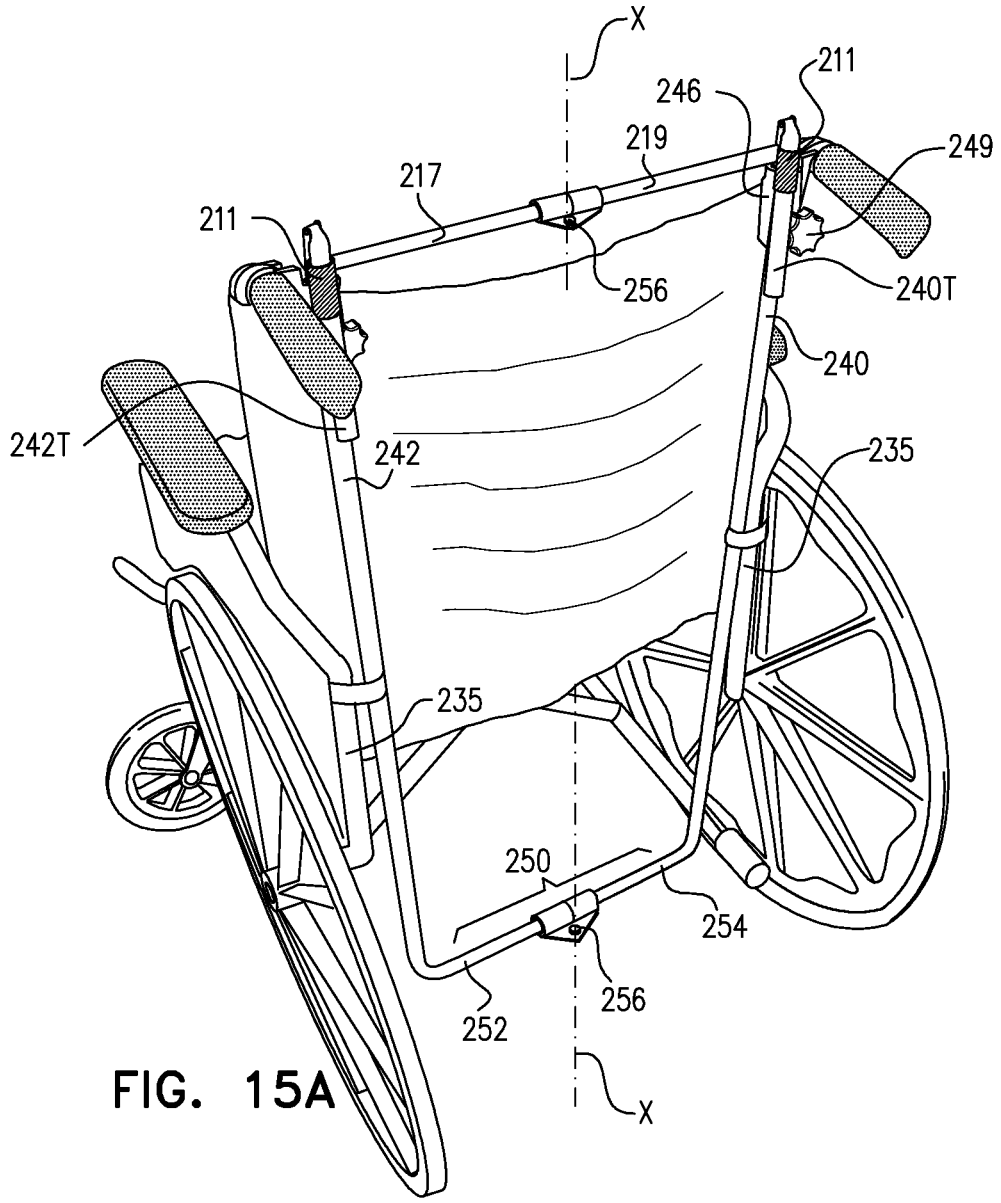
FIG. 15A illustrates the wheelchair of FIG. 14A with a top portion of the support posts folded.

It is noted that at the lowermost position of the head support assembly 10 (FIGS. 7, 11A, 15A) the top end of the support posts 140 and 142 extends in close proximity with a top surface of the coupler unit 146. According to a particular example, the coupler unit 146 is configured with a cutout portion 147 (best seen in FIGS. 10, 12A and 12B) such that at the lowermost position of the head support assembly 110, the top ends of the support posts 140 and 142 are flush with a top of the coupler unit 146 (and with the push handles 151 of the wheelchair 114).

A flexible head support unit 170 (FIGS. 9, 12, 13) is attachable over top portions 140T and 142T of the support posts 140 and 142, respectively. The head support unit 170 comprises a head support body 172 configured at respective side ends thereof with a pair of right and left attachment elements 174 configured for mounting over a top portion 140T and 142T, of the support posts 140 and 142, respectively. An adjustment mechanism in the form of a pair of fastening straps 178 is provided for adjusting the distance between the attachment elements 174 at least from an extended position towards a retracted position by tightening the straps 178. When the head support unit 170 is mounted on the over top portions 140T and 142T, the pair of fastening straps 178 is configured for tensioning the head support unit 170 over the top portions 140T and 142T, thereby causing the attachment elements 174 to deform and to approach each other. It is appreciated that in other examples, the flexible head support body 172 can be formed as a rigid member with the flexible right and left attachment elements 174.

Figure 13:
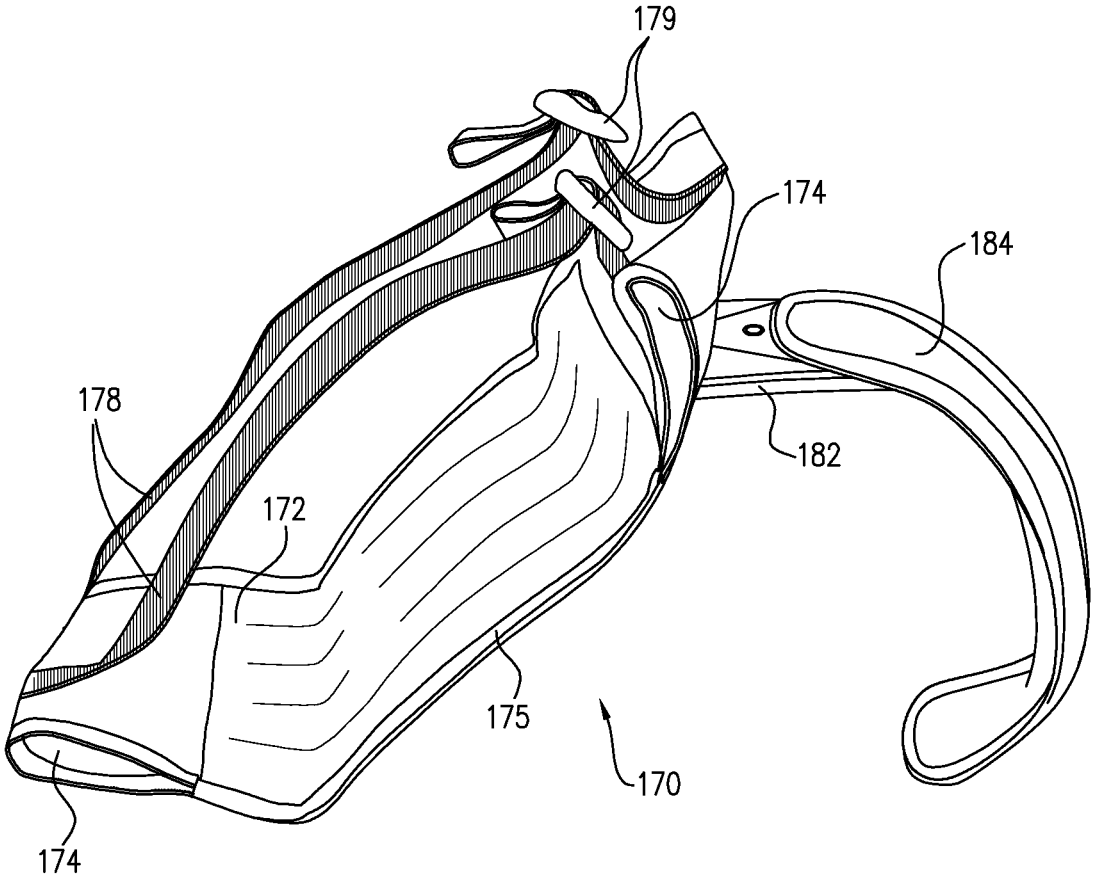
FIG. 13 is a bottom perspective view of the head support unit of FIG. 9.

As shown in FIG. 13, tightening the straps 178 causes the attachment elements 178 to approach each other, and the distance therebetween to be decreased. Moreover, the straps 178 have a fixing mechanism in the form of a latch 179, configured for preventing the attachment elements 178 to be adjusted from any intermediate position (shown in FIG. 9) towards their extended position.

Figure 12A:
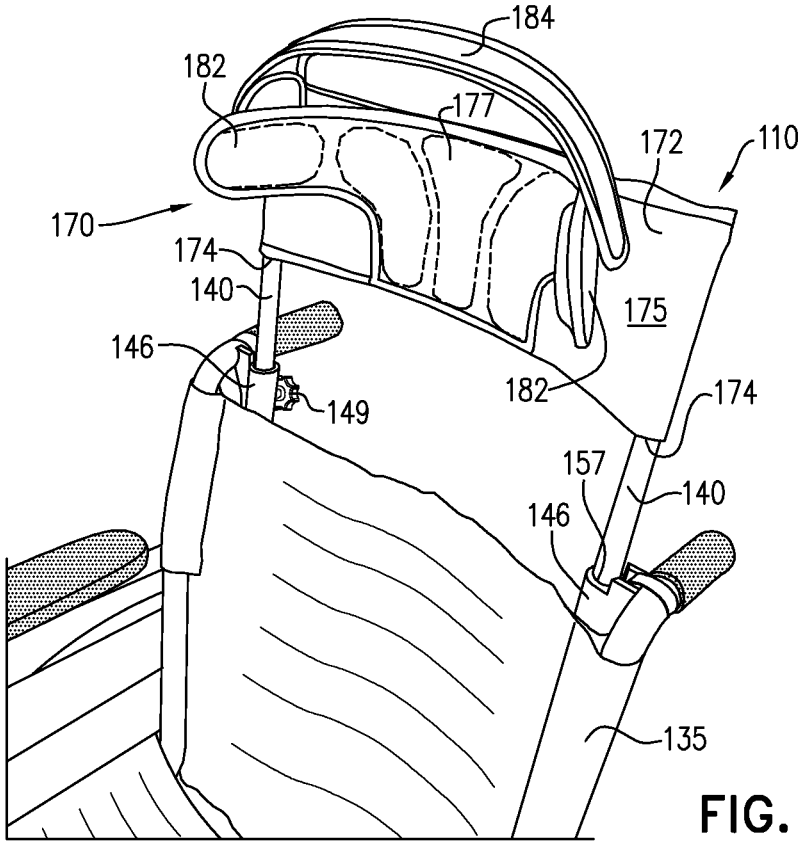
FIG. 12A is front perspective view of a portion of the wheelchair of FIG. 9, the restraining member at an upward, open position.
Figure 12B:
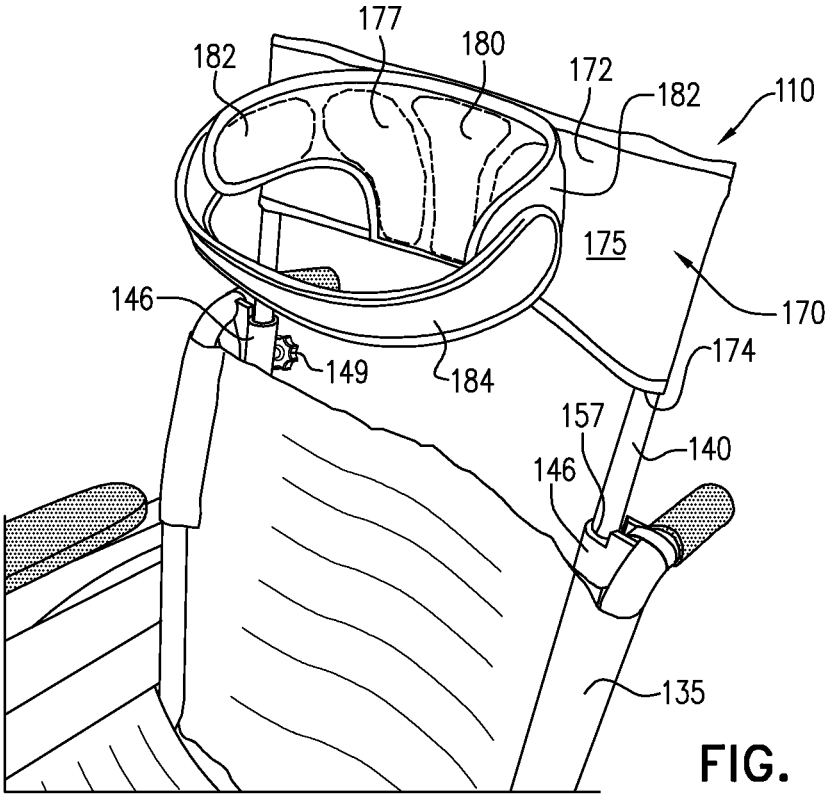
FIG. 12B is front perspective view of a portion of the wheelchair of FIG. 9, the restraining member at a closed, restraining position.

The flexible head support unit 170 is configured at a front portion 175 thereof with an integrally mounted head restraint 173 configured with a back portion 180 and two side portions 182 extending therefrom, the side portions 182 are foldable with respect to the back portion 180 so as to allow the head restraint 173 to assume a first state in which the side portions 182 are spaced from each other at a first extent, (open position as in FIG. 12A) and a second state in which the side portions are spaced from each other to a second extent which is smaller than the first extent (closed position as in FIG. 12B). A flexible restraining member 184 is pivotally articulated to the side portions 182 and is configured for rotation at least between an upward position (FIG. 12A) and a downward position (FIG. 12B), wherein displacement of the restraining member 184 between its upward position and its downward position is configured to cause the restraining member 184 to assume its first and second states, respectively.

The head restraint 173 is integral with the head support unit 170 or it can be detachably attached thereto, e.g. by a hook and pile fastener (Velcro™) facilitating fine adjusting of elevation and angularity of the head restraint 173, so as to suit particular needs of an individual occupying the wheelchair.

At an operative, unfolded position of the wheelchair 110, the support posts extend upright with the top portions 140T and 142T extending above a top edge of the back rest 132, at a an adjustable projection, with the flexible head support unit 170 tensioned therebetween. When it is required to adjust elevation of the head support unit 170 all that is required is to loosen the set screws 149 of the coupler units 146 and then pull/push the support posts frame to assume the required elevation. Tensioning the straps 78 of the head support unit 170 increases stability and rigidity of the U-shaped frame constructed by the support posts and bottom bar.

Folding the wheelchair 110 takes place simply by collapsing the left bar member 152 and the right bar member 154 by displacement of the coupler member 156 forwards, in direction of arrow F (FIG. 4), e.g. by the foot of an individual. Once the left bar member 152 and the right bar member 154 are collapsed, the wheelchair 114 will be easily collapsed as known per-se, into the fully collapsed position of FIG. 11B, with the head support unit 170 collapsing accordingly. If required (e.g. for reducing overall space of the folded wheelchair such as when storing or mounting into a vehicle), the head support unit 170 can be removed and the support posts 140 and 142 can be retracted (FIG. 5A).

As can be seen, at the folded position (FIGS. 11A and 11B) the left bar member 152 and the right bar member 154 extend substantially parallel to one another and within the space between the wheels 126 of the wheelchair. At a fully expanded position (FIGS. 7, 8 and 16) the left bar member 152 and the right bar member 154 substantially coextend.

It is further appreciated that one or more intermediate bars (not shown) can extend between the support posts 140 and 142, each of the intermediate bars comprising a left bar member and a right bar member, respectively, and are coupled to one another by a coupler similar to coupler 156 as disclosed hereinabove, facilitating their collapsing. Such additional couplers are disposed coaxially with respect to coupler 156, pivotally about axis X, to facilitate folding of the structures.

Figure 14A:
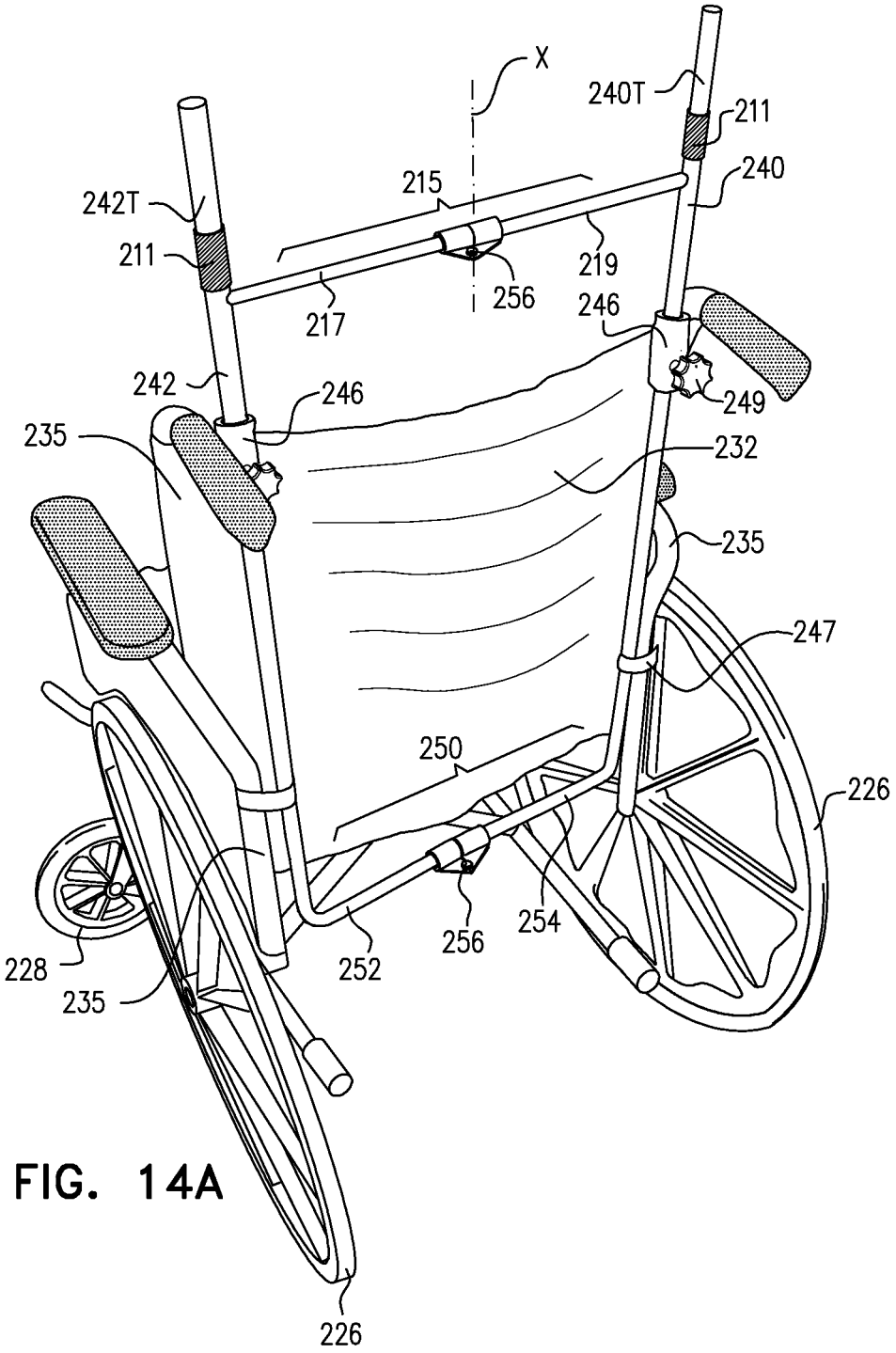
FIG. 14A illustrates a rear perspective view of a foldable wheelchair fitted with a modular head support assembly according to yet another example of the presently disclosed subject matter, with its support posts retracted and head support unit removed.
Figure 14B:
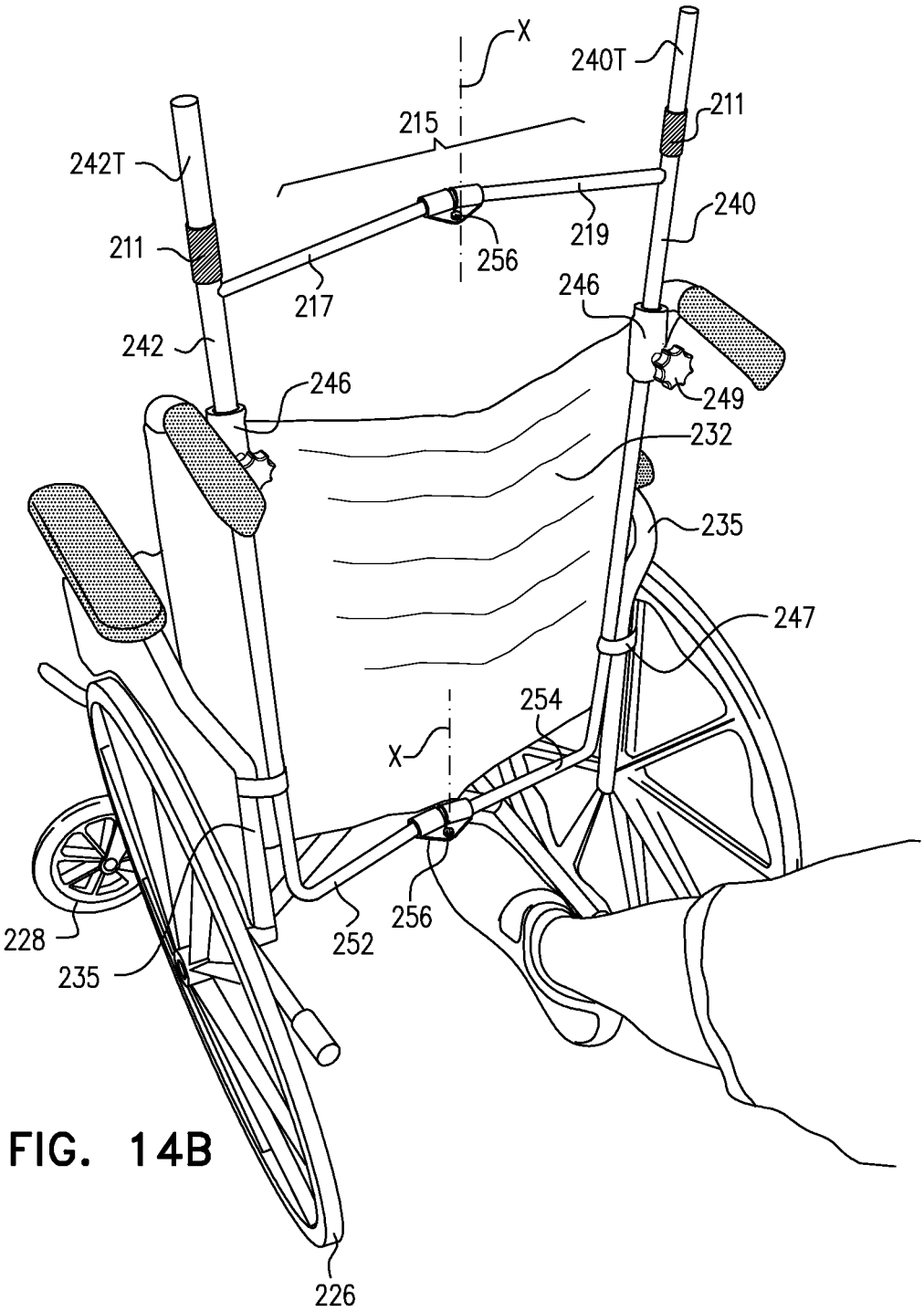
FIG. 14B illustrates a first step of folding the wheelchair of FIG. 14A.
Figure 15B:
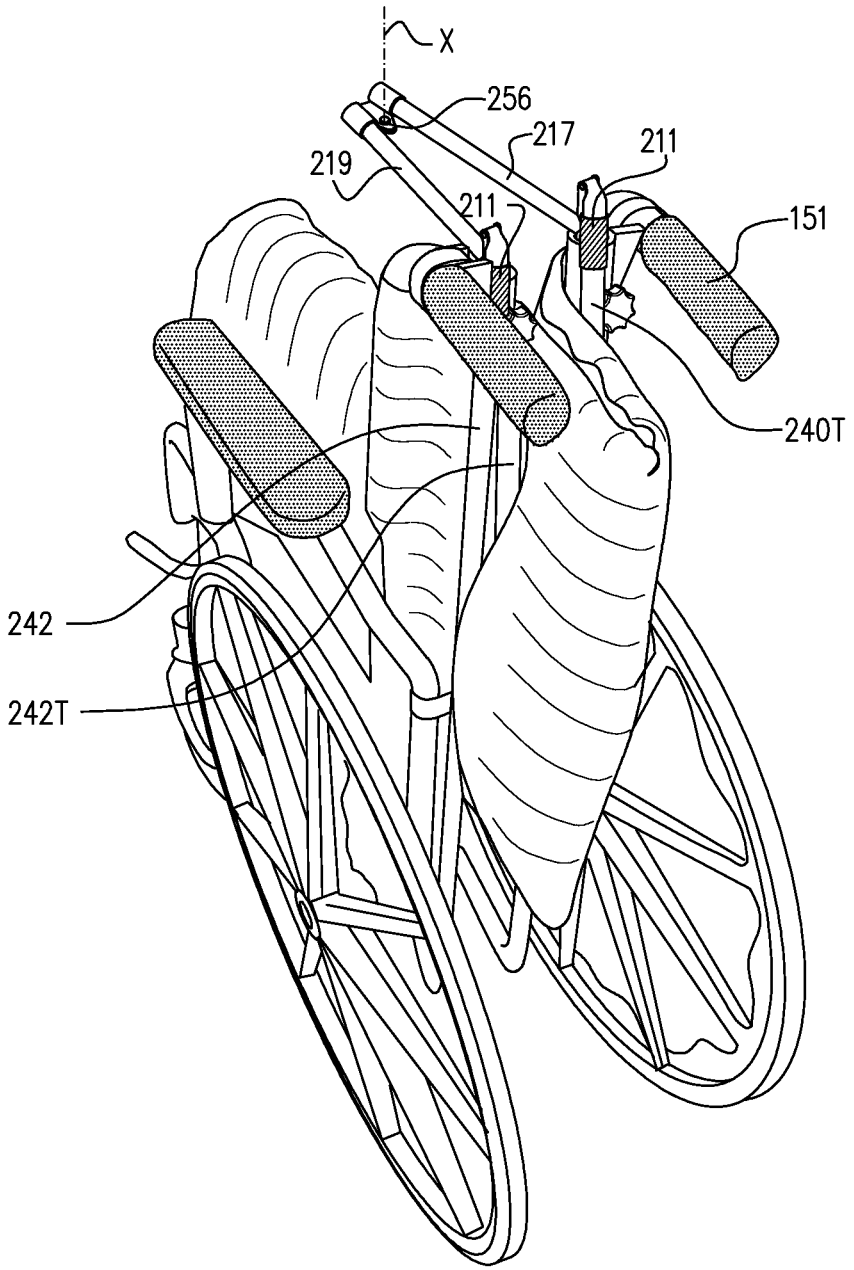
FIG. 15B illustrates the wheelchair of FIG. 8A at a fully folded position.
Figure 16:
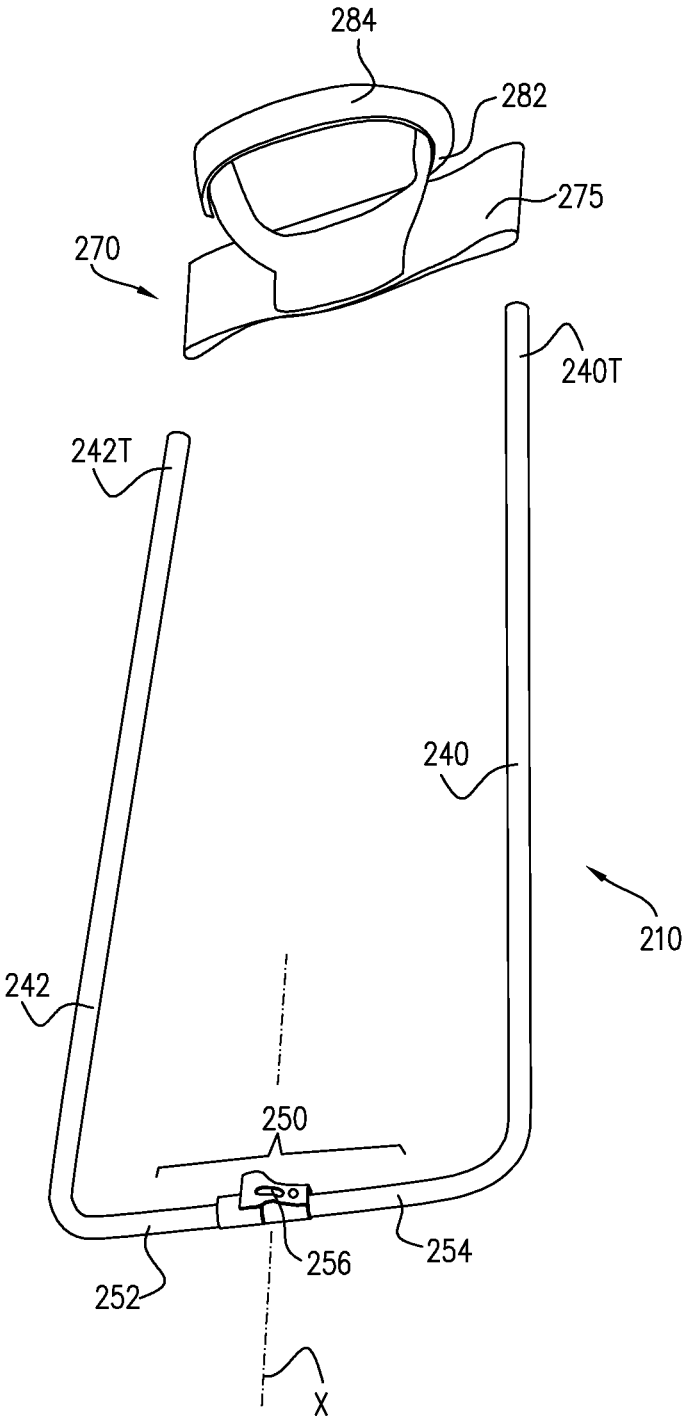
FIG. 16 illustrates a perspective view of the modular head support assembly.

Further attention is now being directed also to FIGS. 14 and 15 of the drawings, illustrating an embodiment of the disclosure. The difference in the currently disclosed embodiment resides in the provision of a foldable top segment at a top of the support posts. Accordingly, like elements are designated with like reference numbers, however shifted by 100.

The top segments 240T and 242T are foldable with respect to the support posts 240 and 242, respectively, through a pivot coupler 211. Pivot coupler 211 can be configured with a locking mechanism configured to prevent unintentional folding of the top segments. A top bar 215 is configured with a left bar member 217 extending from an upper portion of the left support post 242, and a right bar member 219 extending from an upper portion of the right support post 240, wherein the left bar member 217 and right bar member 219 are pivotally articulated to one another through a coupler member 256 with a pivot axis X extending substantially parallel to the support posts 240 and 242 and coextending with the axis X of the bottom bar 250.

The arrangement is such that the flexible head support unit 170 (as disclosed hereinabove) is mountable over the foldable top segments 240T and 242T. In use, the foldable top segments 240T and 242T can be folded albeit positioning of the flexible head support unit 170, wherein at the folded position of the wheelchair (FIG. 15B) the left bar member 217 and a right bar member 219 extend substantially parallel forwards from the support posts 240 and 242, whist the top segments 240T and 242T are folded over the support posts and are disposed substantially parallelly with respect thereto.

It is appreciated that the foldable top segments 240T and 242T at a top of the support posts 240 and 242 can replace the bottom bar 250 or be in addition thereto.

Folding and unfolding of the wheelchair takes place similar to the arrangement disclosed hereinbefore in connection with the previous example.

Attention is now made to FIGS. 17A to 17G of the drawings, directed to yet another example of head support assembly according to the present disclosure, generally designated 310, mounted on a seat in the form of a generic type wheelchair, generally designated 314.

The wheelchair 314 is a collapsible wheelchair of the type comprising a right side frame member 318 and a left side frame member 320 articulated to one another by a collapsible X-shaped cross-frame 324, each side frame mounted over a large rear wheel 326 and a front caster wheel 328, with a foldable seat 330 and a foldable backrest 332 extending between the right side frame member 318 and the left side frame member 320. The wheelchair 314 is collapsible between a collapsed position (shown in FIG. 17B) and a deployed position (shown in FIG. 17A).

Whilst a specific wheelchair is illustrated in the annexed drawings, it is appreciated that other types and shapes of wheelchairs can be used as well.

The head support assembly 310 is a modular system that can be configured as an add-on assembly for mounting on a wheelchair, or pre-fitted on a wheelchair.

In the examples of FIG. 17A to 17G, the head support assembly 310 comprises a pair of support posts, namely a right support post 340 and a left support post 342, configured for attaching to the right side frame member 318 by a right coupler unit 346, and to the left side frame member 320 by a left coupler unit 348, respectively. The right coupler unit 346 and the left coupler unit 348 are identical to the right coupler unit 46 and the left coupler unit 48 described above. The right coupler unit 346 and the left coupler unit 348 are configured for facilitating sliding displacement of the right support post 340 left support post 342 therein between an upper position shown in FIG. 17A and a lower position shown in FIG. 17B, and for fixing the right and left support posts 340 and 342 at any position between the upper position and the lower position.

The head support assembly 310 further comprises a bottom support unit 350 having a support body 352 structured of a right body member 353 and a left body member 354 pivotally articulated to one another by a first adjustment mechanism in the form of a pivot joint 355. The right body member 353 has a right opening 353' with a tunnel formed therein and a left opening 354' with a left tunnel formed therein.

The bottom support unit 350 further comprises a right attachment element 360 and a left attachment element 370 disposed at opposite sides of the bottom support unit 350 and configured for articulation at bottom portions of the right support post 340 and the left support post 342, respectively. The right attachment element 360 is connected to the right body member 353 and the left attachment element 370 is connected to the left body member 354. The pivot joint 355 is configured for selectively adjusting the position of the right attachment element 360 and the left attachment element 370 with respect to each other between a first extended position (shown in FIG. 17C) and a first retracted position (shown in FIG. 17D).

The adjustment of the position of the right attachment element 360 and the left attachment element 370 is performed by pivotally displacing them about a rotation axis Y extending through the pivot joint 355. The pivotal displacement of the right body member 353 with respect to the left body member 354 is configured for selectively adjusting the position of the right attachment element 360 and the left attachment element 370 with respect to each other, between the first extended position (shown in FIG. 17C) and the first retracted position (shown in FIG. 17D). This operation of the pivot joint 355 is configured for displacing the right attachment element 360 and the left attachment element 370 to and from each other, so as to fit the distance therebetween to the distance between the support posts 340 and 342.

Although the pivot joint 355 is not configured for fixing the position of the right body member 353 with respect to the left body member 354 at any particular intermediate position between the extended position and the retracted position, according to other examples, the pivot joint 355 can be provided with any known in the art fixing mechanism capable of providing such fixing operation.

Figure 17A:
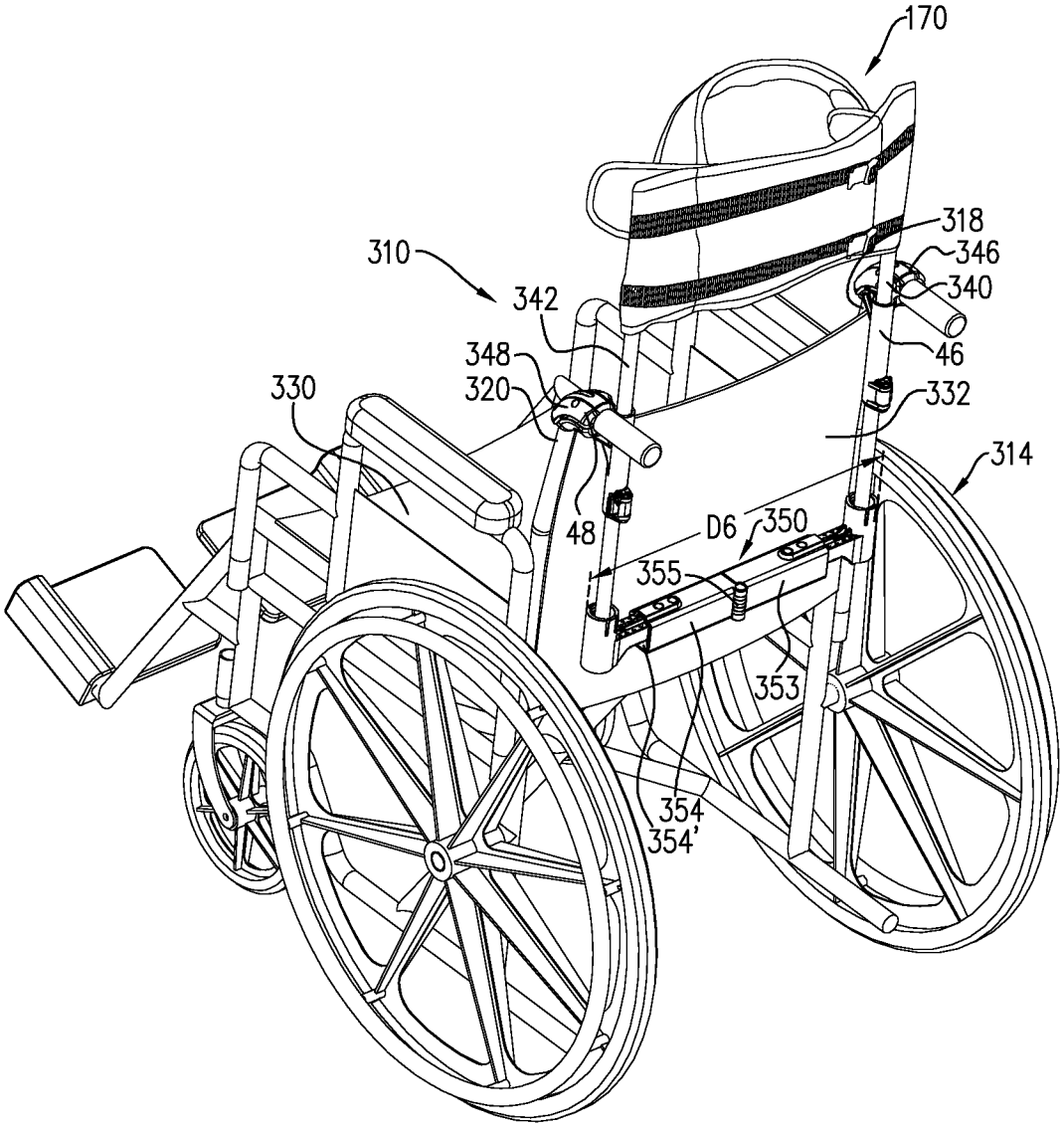
FIG. 17A illustrates a rear perspective view of a foldable wheelchair fitted with a modular head support assembly fitted with an upper support unit and a lower support unit with their right attachment element and left attachment element at an intermediate position, respectively, according to yet another example of the presently disclosed subject matter.
Figure 17B:
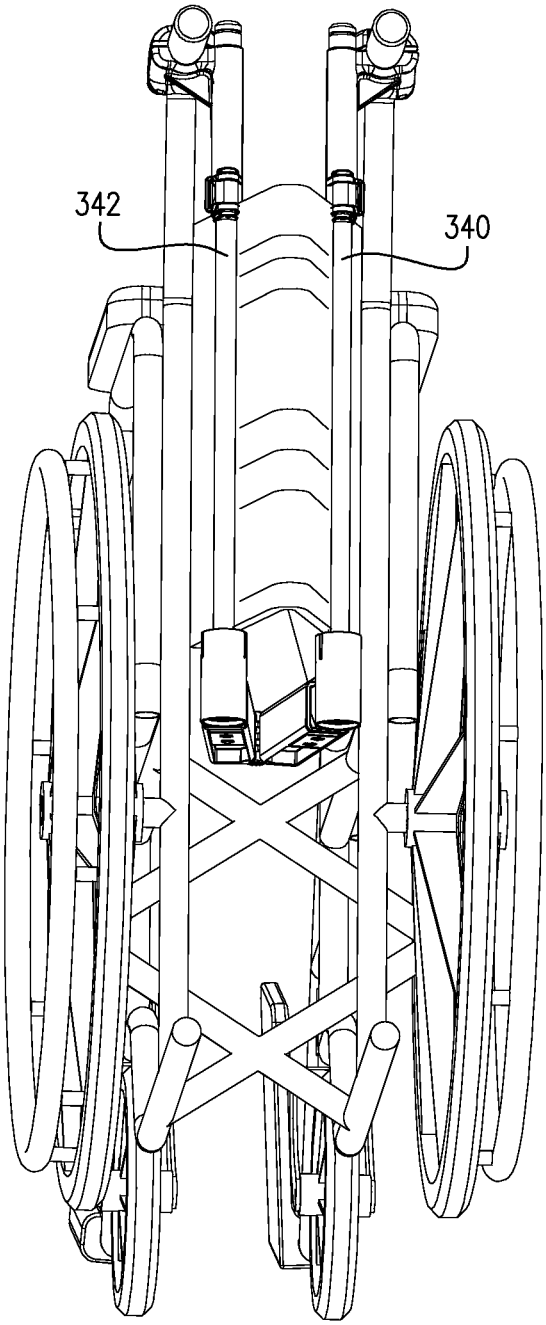
FIG. 17B illustrates the wheelchair of FIG. 17A with the head support assembly at a position lower than in FIG. 17A and with the wheelchair at a collapsed position, and with the upper support unit removed.
Figure 17C:
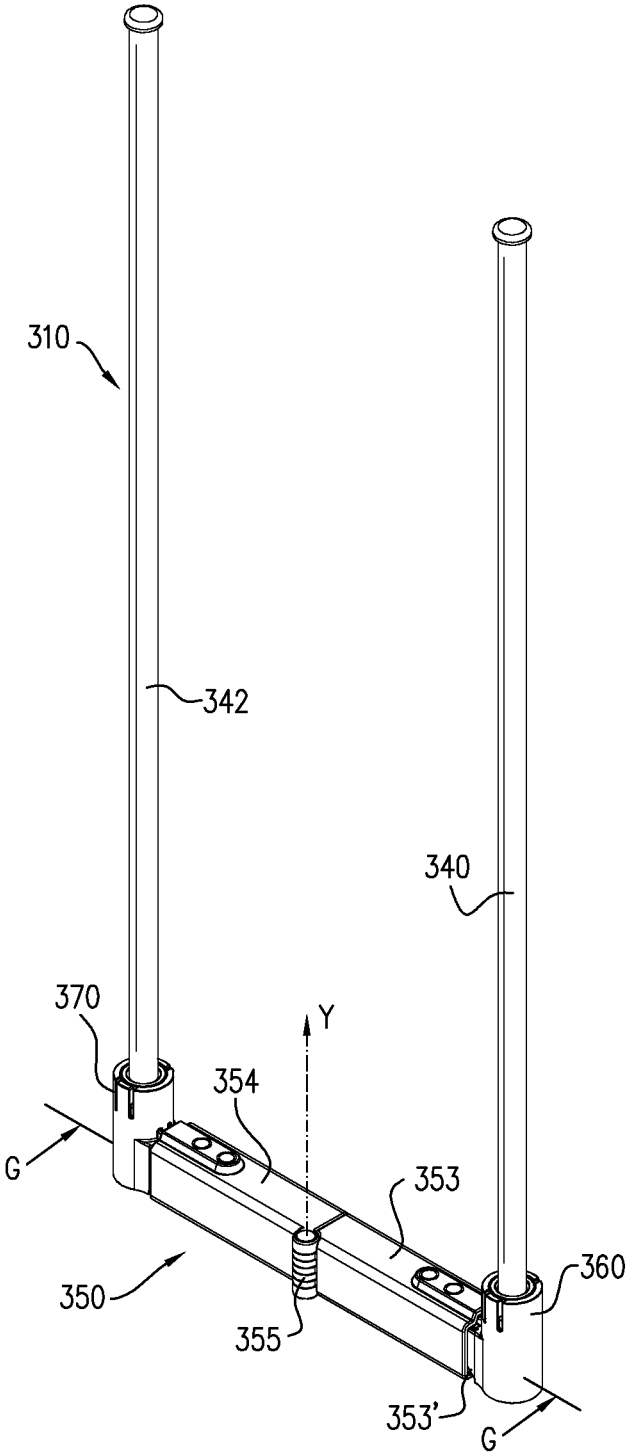
FIG. 17C illustrated a perspective view of the lower support unit of FIG. 17A, with its right attachment element and left attachment element at an extended position with respect to its pivotal adjustment mechanism of the lower support unit, and with its right attachment element and left attachment element at a retracted position with respect to its linear adjustment mechanism of the lower support unit.
Figure 17D:
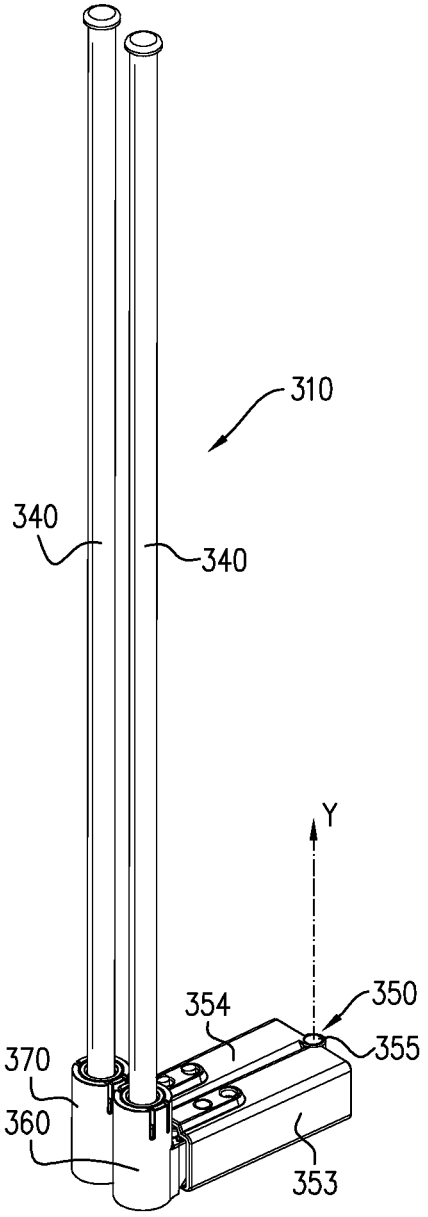
FIG. 17D illustrated a perspective view of the lower support unit of FIG. 17A, with its right attachment element and left attachment element at a retracted position with respect to its pivotal adjustment mechanism of the lower support unit, and with its right attachment element and left attachment element at a retracted position with respect to its linear adjustment mechanism of the lower support unit.
Figure 17E:
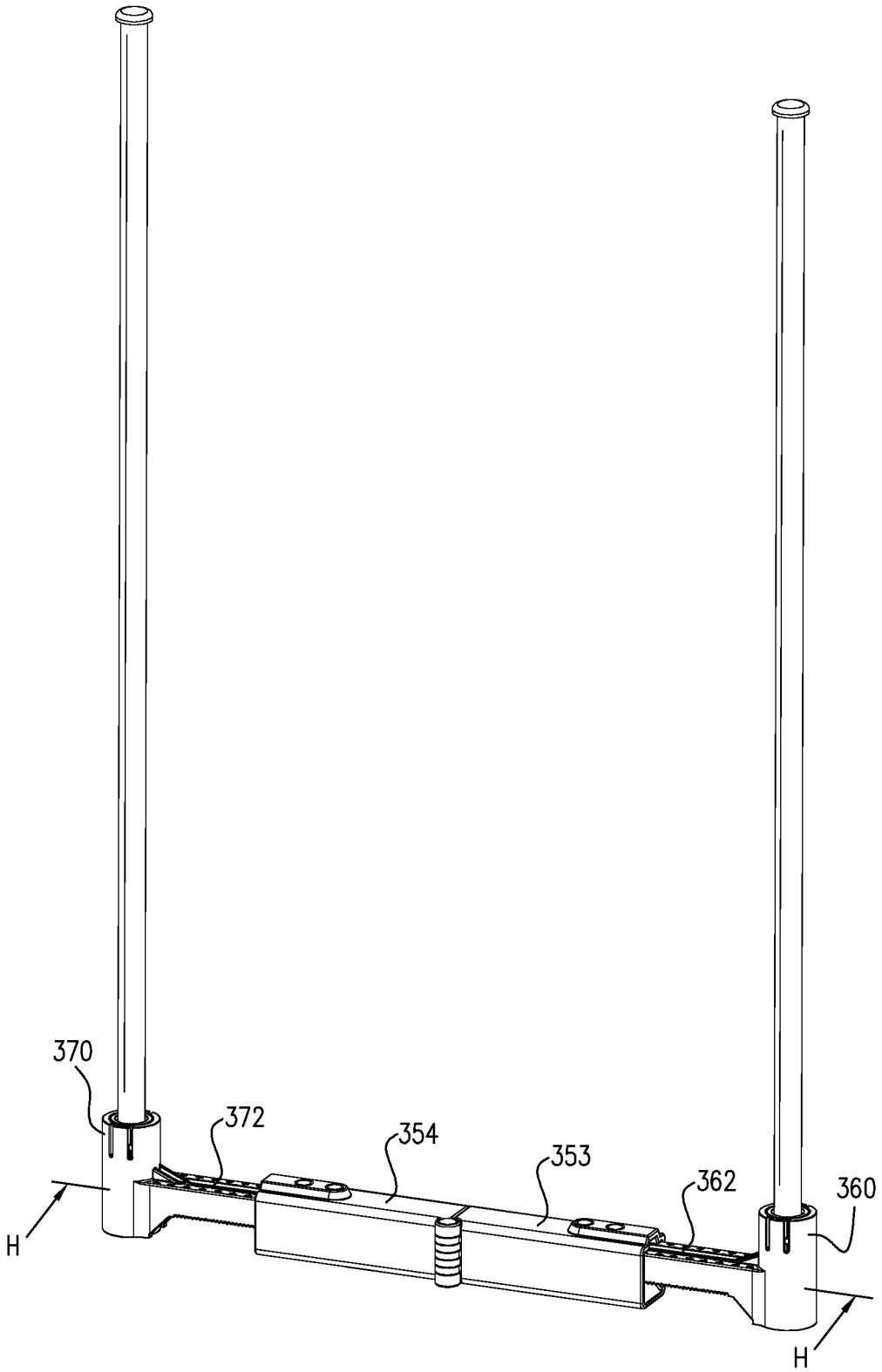
FIG. 17E illustrated a perspective view of the lower support unit of FIG. 17A, with its right attachment element and left attachment element at an extended position with respect to its pivotal adjustment mechanism of the lower support unit, and with its right attachment element and left attachment element at an extended position with respect to its linear adjustment mechanism of the lower support unit.
Figure 17F:
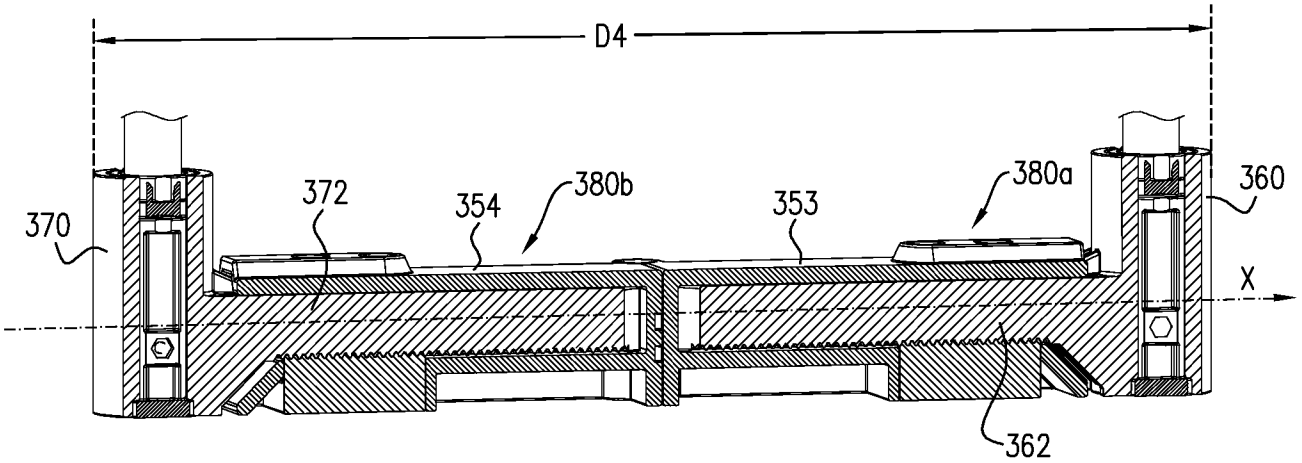
FIG. 17F is a cross-sectional view along line G-G in FIG. 17C.
Figure 17G:
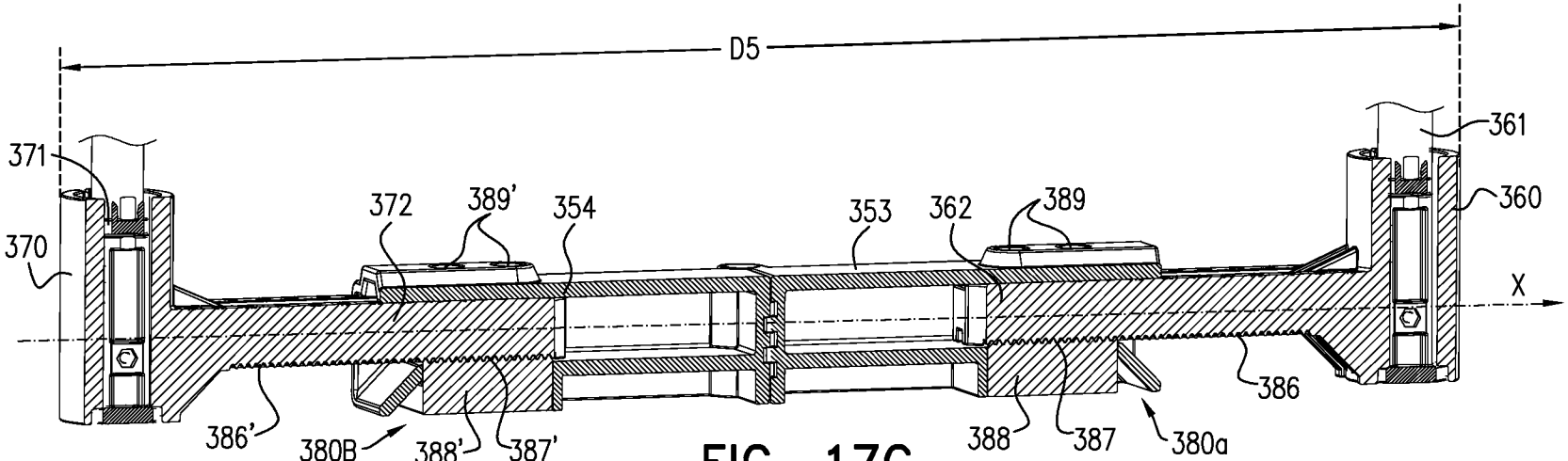
FIG. 17G is a cross-sectional view along line H-H in FIG. 17E.

As sown in FIG. 17G, the right attachment element 360 is connected to the right body member 353 via a right extending element 362, and the left attachment element 370 is connected to the left body member 354 via a left extending element 372. Both the right extending element 362 and the left extending element 372 are slidable within the tunnel of their respective body member.

The right extending element 362 constitutes a part of a second adjustment mechanism 380*a* and the left extending element 372 constitutes a part of a third adjustment mechanism 380*b*. The second adjustment mechanism 380*a* is configured to displace and fix the right attachment element 360 with respect to the left attachment element 370 at a plurality of positions by displacing and fixing the right extending element 362 with respect to the right body member 353. The third adjustment mechanism 380*b* is configured to displace and fix the left attachment element 370 with respect to the right attachment element 360 at a plurality of positions by displacing and fixing the left extending element 372 with respect to the left body member 354. The second adjustment mechanism 380*a* and the third adjustment mechanism 380*b* operable independently from each, and their manner of operation is detailed below.

As shown in FIG. 17A, at the deployed position of the wheelchair 314, the right support post 340 and the left support post 342 extend vertically upwards in parallel to each other, defining a certain distance therebetween. When the right support post 340 and the left support post 342 are attached to the right and left side frame members 318 and 320, the distance therebetween is dictated by the width of the wheelchair 314, and in particular, by the structure and the distance between the right and left side frame members 318 and 320 of the wheelchair 314. This distance can change from one seat to another, or be dependent on the locations at which the right and left posts are articulated to the side frame of a particular seat. Thus, the right attachment element 360 and the left attachment element 370 are adjustable with respect to each other in order to detachably attach the bottom support unit 350 to the right and left support posts 340 and 342 and to fixedly fit the distance therebetween and respectively between right and left side frame members 318 and 320. This adjustment enables the right attachment element 360 and the left attachment element 370 to fixedly assume any one intermediate position from a plurality of intermediate positions between the extended position and the retracted position. In the example of FIG. 17A, the right attachment element 360 and the left attachment element 370 are fixedly adjusted to an intermediate position which fits the distance between the right support post 340 and the left support post 342, dictated by the distance between the right and left side frames members 318 and 320 at the deployed position of the wheelchair 314.

The second adjustment mechanism 380*a* is operable by a user to increase or decrease the distance between the right attachment element 360 to the left attachment element 370 by pulling and pushing the right attachment element 360 along the longitudinal axis X with respect to the right body member 353. The third adjustment mechanism 380*b* is operable by a user to increase or decrease the distance between the right attachment element 360 to the left attachment element 370 by pulling and pushing the left attachment element 370 along the longitudinal axis X with respect to the left right body member 354.

Reference is now made particularly to FIGS. 17F and 17G, illustrating the structure of the bottom support unit. As mentioned above, the right attachment element 360 and the left attachment element 370 are each separately adjustable between an extended position and a retracted position (shown in FIG. 17F) by displacing them along a longitudinal axis X, so that at the retracted position, the distance between the right attachment element 360 and the left attachment element 370 is a minimal first distance D4, and at the extended position, the distance between the right attachment element 360 and the left attachment element 370 is a maximal second distance D5 which is greater than the first distance D4. As shown in FIG. 17F, at the retracted position, the right attachment element 360 and the left attachment element 370 are adjacently positioned to opposite lateral sides of the right body member 353 and the right body member 354, respectively. At the intermediate position of the right attachment element 360 and the left attachment element 370 shown in FIG. 17A, the right attachment element 360 and the left attachment element 370 are spaced from each other to a third distance D6 which is greater than D4 and smaller than D5.

As shown in FIG. 17G, each one of the second adjustment mechanism 380*a* and the third adjustment mechanism 380 is further configured for fixing the position of the right attachment element 360 and the left attachment element 370 with respect to each other. The second adjustment mechanism 380*a* thus comprises a first fixing mechanism in the form of a lower rack 386 of the right extending element 362 and an upper rack 387 of a right fixing member 388, which upon engagement configured to fix the right attachment element 360 and the left attachment element 370 at any one intermediate position from a plurality of intermediate positions between the extended position and the retracted position. The right fixing member 388 is mounted to the right body member 353 by two spring screws 389, allowing slight displacement of the right fixing member 388 upwardly and downwardly upon displacement of the right extending element 362 along the longitudinal axis X, while the right fixing member 388 normally tends to be displaced to its upward fixing position.

The third adjustment mechanism 380*b* comprises a second fixing mechanism in the form of a lower rack 386' of the left extending element 372 and an upper rack 387' of a left fixing member 388', which upon engagement configured to fix the right attachment element 360 and the left attachment element 370 at any one intermediate position from a plurality of intermediate positions between the extended position and the retracted position. The left fixing member 388' is mounted to the left body member 354 by two spring screws 389, allowing slight displacement of the left fixing member 388' upwardly and downwardly upon displacement of the left extending element 372 along the longitudinal axis X, while the right fixing member 388' normally tends to be displaced to its upward fixing position.

As shown in FIG. 17A, the flexible head support unit 170 of FIGS. 9, 11B, 12A, 12B and 13 is articulated to the right support post 340 and to the left support post 342. Therefore, all the above explanations with respect to the flexible head support unit 170 are similarly relevant for the example of FIGS. 17A to 17G.

Each one of the right attachment element 360 and the left attachment element 370 comprises a pivotal member 361 and 371, respectively, pivotally rotatable within an interior of the respective attachment element. The pivotal members 361 and 371 are configured for tightly receiving a bottom end of their respective support post via a mounting bore, so that during the course of collapsing the wheelchair 314, the right body member 353 and the left body member 354 are pivoted with respect to each other, while the support posts and their respective pivotal members 361 and 371 do not rotate. This allows easily collapsing the wheelchair 314 without requiring detaching the head support assembly 310 from the wheelchair 314, or facilitating rotation of the support posts 340 and 342 with respect to their coupler units.

The invention claimed is:

1. A support unit for a modular head support assembly having a right support post and a left support post, said support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting a position of the right attachment element and the left attachment element with respect to each other, at least from an extended position towards a retracted position, wherein the adjustment mechanism is configured to simultaneously adjust the position of both the right attachment element and the left attachment element.

2. The support unit of claim 1, wherein said adjustment mechanism further comprises a fixing mechanism configured to prevent said right attachment element and said left attachment element from being adjusted at least from any one intermediate position from a plurality of intermediate positions towards the extended position.

3. The support unit of claim 2, wherein said fixing mechanism configured to fix said right attachment element and said left attachment element at any one intermediate position from a plurality of intermediate positions between the extended position and the retracted position.

4. The support unit of claim 1, wherein the adjustment mechanism is configured for adjusting the position of the right attachment element and the left attachment element with respect to each other between the extended position and the retracted position.

5. The support unit of claim 1, wherein the support body has a longitudinal axis, and the position of the right attachment element and the left attachment element with respect to each other is linearly adjustable along said longitudinal axis.

6. The support unit of claim 5, wherein the adjustment mechanism extends at least partially along said longitudinal axis.

7. The support unit of claim 5, wherein the adjustment mechanism extends at least partially within said support body.

8. The support unit of claim 1, wherein at the retracted position, a distance between the right attachment element and the left attachment element is a first distance, and at the extended position, a distance between the right attachment element and the left attachment element is a second distance which is greater than the first distance.

9. The support unit of claim 1, wherein the simultaneous adjustment of the position of the right attachment element and the left attachment element is such that the right attachment element and the left attachment element are displaced at the same distance.

10. The support unit of claim 1, wherein the right attachment element and the left attachment element are disposed at opposite sides of the support body via a right extending element and a left extending element, respectively.

11. The support unit of claim 10, wherein the adjustment mechanism is configured to adjust and fix said right attachment element and said left attachment element with respect to each other by adjusting and fixing the right extending element and said left extending element with respect to the support body.

12. The support unit of claim 10, wherein the adjustment mechanism comprises:

right and left drive elements, oppositely disposed to one another along the length of the right extending element and the left extending element, respectively; and a driving gear comprising a driving portion engaged with both of the right and left drive elements.

13. The support unit of claim 12, wherein the right extending element comprises a right elongate opening formed therein, said right elongate opening comprises a right upper rim and a right lower rim, and the right drive element extends on one of the right upper and lower rim; the left extending element comprises a left elongate opening formed therein, said left elongate opening comprises a left upper rim and a left lower rim, and the left drive element extending along the opposite rim to the rim on which the right drive element extends along; and wherein said driving portion is extending through both the right elongate opening and the left elongate opening.

14. The support unit according to claim 1, wherein said support body is configured with a front portion to which a head restraint is attachable.

15. The support unit according to claim 1, wherein the support body comprises a handle, extending upwards and spaced from a top portion of the support body, forming a gap therebetween.

16. The support unit according to claim 1, wherein the support body comprises a lower section having at least one aperture disposed thereon.

17. The support unit according to claim 1, wherein said adjustment mechanism is configured for selectively adjusting the position of the right attachment element and the left attachment element by displacing or facilitating displacement thereof.

18. The support unit according to claim 1, wherein the support body comprises a right body member connected to the right attachment element at a right end thereof, and a left body member connected to the left attachment element at a left end thereof, said right body member and said left body member are pivotally articulated to one another by the adjustment mechanism; and wherein pivotal displacement of the right body member with respect to the left body member is configured for selectively adjusting the position of the right attachment element and the left attachment element with respect to each other, between the extended position and the retracted position.

19. The support unit according to claim 1, wherein each one of the right and left attachment elements comprises a mounting bore configured for receiving therein a section of the respective support post.

20. A support unit for a modular head support assembly having a right support post and a left support post, said support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting a position of the right attachment element and the left attachment element with respect to each other, at least from an extended position towards a retracted position;

the right attachment element and the left attachment element are disposed at opposite sides of the support body via a right extending element and a left extending element, respectively;

wherein the adjustment mechanism comprises:

right and left drive elements, oppositely disposed to one another along the length of the right extending element and the left extending element, respectively; and a driving gear comprising a driving portion engaged with both of the right and left drive elements.

21. A support unit for a modular head support assembly having a right support post and a left support post, said support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting a position of the right attachment element and the left attachment element with respect to each other, at least from an extended position towards a retracted position;

wherein the support body comprises a handle, extending upwards and spaced from a top portion of the support body, forming a gap therebetween.

22. A support unit for a modular head support assembly having a right support post and a left support post, said support unit comprising:

a support body;

a right attachment element and a left attachment element configured for articulation with said right support post and said left support post, respectively, said right attachment element and said left attachment element being disposed at opposite sides of the support body; and an adjustment mechanism configured for selectively adjusting a position of the right attachment element and the left attachment element with respect to each other, at least from an extended position towards a retracted position;

wherein the support body comprises a right body member connected to the right attachment element at a right end thereof, and a left body member connected to the left attachment element at a left end thereof, said right body member and said left body member are pivotally articulated to one another by the adjustment mechanism; and wherein pivotal displacement of the right body member with respect to the left body member is configured for selectively adjusting the position of the right attachment element and the left attachment element with respect to each other, between the extended position and the retracted position.

* * * * *